US007249477B2

(12) United States Patent
Toloday et al.

(10) Patent No.: US 7,249,477 B2
(45) Date of Patent: Jul. 31, 2007

(54) CONTROL FOR EXIT DEVICE

(75) Inventors: David V. Toloday, Terre Haute, IN (US); Marlin Austin, Speedway, IN (US); Loren D. Mueller, Indianapolis, IN (US); Paul D. Bilyeu, Danville, IN (US)

(73) Assignee: Von Duprin, Inc., Indianapolis, IN (US)

( * ) Notice: Subject to any disclaimer, the term of this patent is extended or adjusted under 35 U.S.C. 154(b) by 62 days.

(21) Appl. No.: 11/182,892

(22) Filed: Jul. 15, 2005

(65) Prior Publication Data

US 2006/0010942 A1 Jan. 19, 2006

Related U.S. Application Data

(60) Provisional application No. 60/588,498, filed on Jul. 16, 2004.

(51) Int. Cl.
*E05B 47/00* (2006.01)
*E05B 3/00* (2006.01)

(52) U.S. Cl. ..... 70/279.1; 70/92; 70/224; 70/277; 292/92; 292/244; 292/336.3

(58) Field of Classification Search ..... 70/279.1, 70/92, 465, 277, 107, 210, 224, 467, 468, 70/389, 275, 280, 278.7, 248.7; 292/92, 292/336.3, 165, 244
See application file for complete search history.

(56) References Cited

U.S. PATENT DOCUMENTS 2,469,018 A * 5/1949 Swanson ..... 70/389
4,028,917 A * 6/1977 Schlage ..... 70/389
4,120,184 A * 10/1978 Gerlach ..... 70/389
4,167,280 A 9/1979 Godec et al.
4,276,760 A * 7/1981 Nolin ..... 70/107
4,305,612 A 12/1981 Hunt et al.
4,427,223 A 1/1984 Godec et al.
4,601,499 A 7/1986 Kim
4,669,283 A * 6/1987 Ingenhoven ..... 70/264
4,741,563 A 5/1988 Cohrs
4,978,151 A 12/1990 Coleman et al.
4,982,986 A * 1/1991 Gressett et al. ..... 292/336.3
5,016,455 A * 5/1991 Hennessy ..... 70/493
D337,715 S 7/1993 Rutherford
5,412,961 A 5/1995 Cain et al.
5,437,174 A * 8/1995 Aydin ..... 70/278.3
5,484,176 A 1/1996 Sallwasser
5,657,653 A 8/1997 Hensley et al.
5,658,026 A * 8/1997 Nigro et al. ..... 292/336.3
5,664,816 A 9/1997 Nigro, Jr. et al.
D416,779 S 11/1999 Trumpinski et al.
5,992,195 A * 11/1999 Huang et al. ..... 70/472

(Continued)

*Primary Examiner*—Brian E. Glessner
*Assistant Examiner*—Alyson Merlino
(74) *Attorney, Agent, or Firm*—Michael Best & Friedrich LLP

(57) ABSTRACT

A control assembly configured for a narrow stile door and for interaction with an exit device. The control assembly provides a means to translate user input, such as rotating a lever to operate a centercase. The control includes a slider for sliding movement within a housing between a first position extending a latchbolt of the exit device and a second position withdrawing the latchbolt. The control assembly configuration incorporates a swivel locking latch rotatable into the path of the slider to prevent the slider from moving out of the first position.

22 Claims, 25 Drawing Sheets

U.S. PATENT DOCUMENTS

| | | | |
|---|---|---|---|
| 6,058,746 | A | 5/2000 | Mirshafiee et al. |
| D428,793 | S | 8/2000 | Bruno |
| D430,786 | S | 9/2000 | Hickman et al. |
| D434,339 | S | 11/2000 | Siller et al. |
| D438,088 | S | 2/2001 | Tomlinson |
| D496,577 | S | 9/2004 | Cohrs et al. |

* cited by examiner 64
92
84
72
76
80
88

96
112
108
104
120
100
128
132
136
132

20

CONTROL FOR EXIT DEVICE

The present application claims priority to provisional application No. 60/588,498 entitled "Control for Exit Device" filed on Jul. 16, 2004.

BACKGROUND

This invention relates generally to a control, such as a door latch assembly, for activation of centercase assemblies for exit devices and more particularly to a control assembly to activate narrow stile panic-type exit devices.

Narrow stile doors present difficulties in the installation and design of controls for exit devices. Stile is a term commonly used to refer to a vertical member of a door frame. Due to the thin width of a narrow stile door (1¾"), many of the commonly available controls to operate exit devices cannot be installed without the control overlapping the glass portion of the door. This overlap is found to be aesthetically undesirable. To avoid overlap, many exit device controls are known which are specifically designed narrow enough to fit upon a narrow stile. However, in order to activate the many diverse functions available in exit devices (rim, surface vertical, concealed vertical) unique controls are often required for each of the different functions.

Many exit device controls also only allow uni-directional input by the user to activate the control. One solution is to centrally locate a uni-directional output of the control such that it matches a centrally located uni-directional input for unlatching of a universal centercase assembly. Bi-directional mechanical activation of the control by the user is desirable over uni-directional activation. This allows the control to be activated in both down and upstroke of its activating lever, knob, etc. Thus the control must convert bi-directional activation input to uni-directional output to match the device.

When unlocked, a control is used to unlatch the exit device latching mechanism. Two types of locking and unlocking controls are what are commonly known as ANSI function 08 and ANSI function 09. ANSI function 09 allows the user to enter a key into the controls key cylinder (often what is commonly known as a mortise type) and turn the key not more than approximately 359 degrees to unlock the control. The key is not removable unless the control is locked. ANSI function 08 allows the user to enter the key into the controls key cylinder and turn the key 360 degrees to unlock the cylinder. If the key is then removed without further rotation of the key, the control remains unlocked. Relocking is the reverse of unlocking. Further, a means of electrically unlocking and locking the control is often desirable when the application is used in an electrically controlled security system. Accordingly, the manufacturer, distributors, and end user must often deal with a large number of parts, assemblies, and stocking units to provide a control to match for each unique device function, handing, and desired unlocking application.

It is apparent then that a control that is narrow enough to fit on a narrow stile, has a universal output location to match a corresponding universal input location on an exit device, provides bi-directional input, is reconfigurable to both left hand and right hand doors, provides for both ANSI 08 and ANSI 09 function in the same assembly, and is configurable for electrical unlocking, is desirable. It is the object of this invention to address the matter and set forth a narrow stile control that accomplishes these functions.

SUMMARY OF THE INVENTION

This invention is a mechanism to convert bi-directional input from a door operator, such as a lever, knob, thumb turn, slider, etc. to a uni-directional output for input to a centercase assembly for a narrow stile door exit device. This mechanism is easily configurable to use on left hand or right hand doors.

This invention incorporates a swivel locking latch and associated mechanism that allows easy configuration from ANSI 08 function to ANSI 09 function. The invention also easily incorporates either electrical fail safe or electrical fail secure locking functions where the locking latch itself does not need to be changed.

Figure 1:
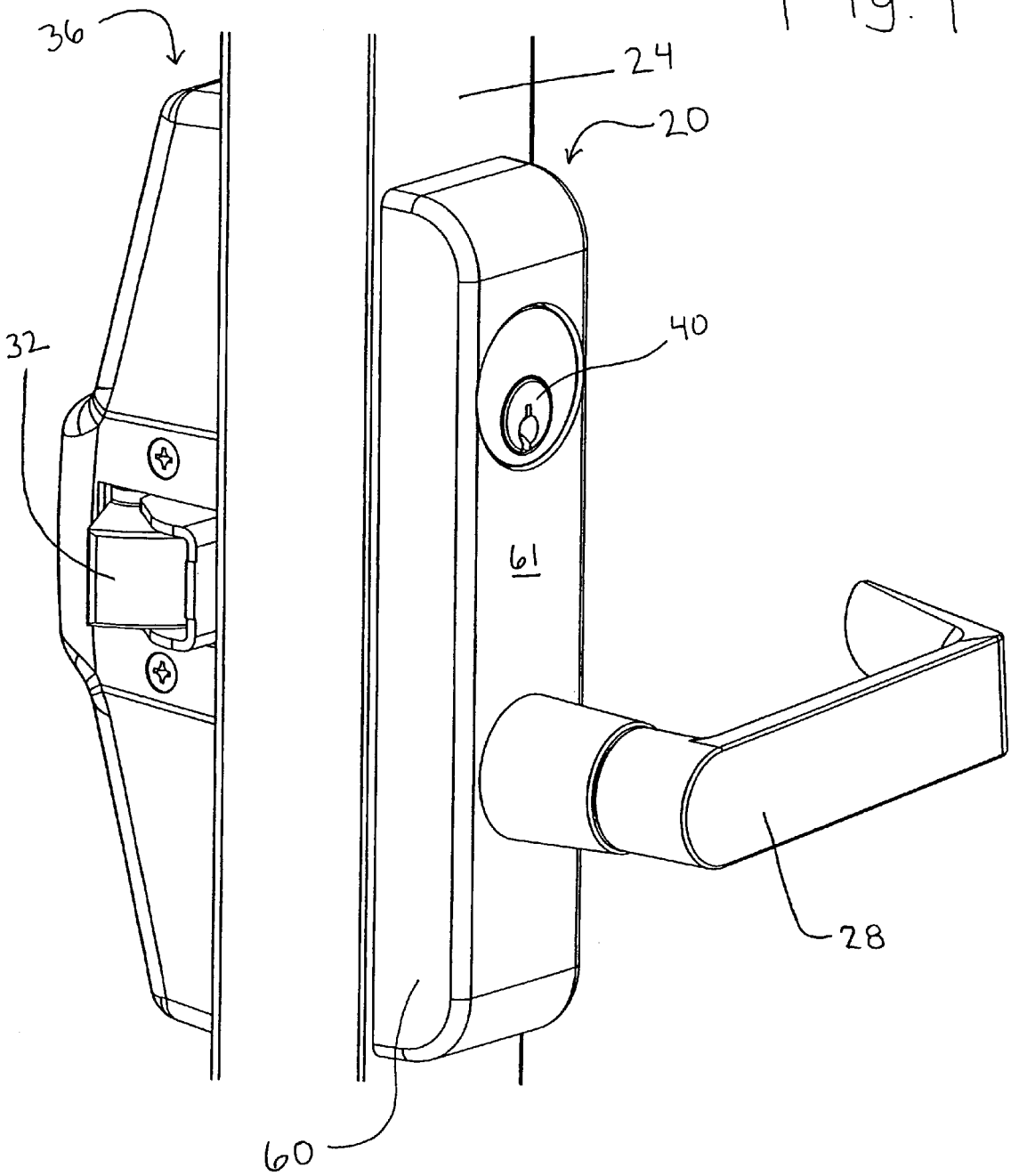
FIG. 1 is a perspective view of a control and an exit device installed on a narrow stile door.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

It is well known in the art to install a control on a narrow stile door with a user controlled lever to command an inward movement of a biased latchbolt to allow opening of the door. The latchbolt is part of a standard centercase assembly and is not the novel subject of the present invention. Centercase assemblies have been well documented in the art, including improvements set forth in U.S. Pat. No. 4,741,563 issued to Von Duprin, Inc. of Indianapolis, Ind. Mortise type key cylinders with locking actuator levers are also well known in the art and are typically used with a key to rotate part of the cylinder to lock or unlock the door. The novelty of the present invention exists within the structure and operation of the locking mechanism within a control, more specifically, the structure and operation of the parts in functional relationship between the output of a key cylinder and the input of a standard centercase. The present invention offers preferred operational characteristics in a compact package for use on a narrow stile door, but is not limited in its application to such a door.

As shown in FIGS. 1-4, a control 20 is installed on a narrow stile door 24 and has a lever 28 for accepting user input, which enables a latchbolt 32 to be selectively withdrawn from a centercase located within an exit device 36. The control 20 also contains a mortise type key cylinder 40, which manipulates an actuator lever 44, to allow the control 20 to be locked or unlocked with a key. The exit device 36 also includes an emergency pushpad (not shown) mounted on an interior side 52 of the door 24. Exit devices are well documented in the art and are available for purchase from various manufacturers. The present invention is a control 20 to operate in conjunction with exit devices of various operation including: rim, surface vertical, and concealed vertical mountings. It should be understood that the control 20 is mounted on an exterior side 56 of the door 24, which opens away from the interior side 52 for emergency exit safety. A housing 60 shields internal components of the control 20; only the key cylinder 40 and lever 28 penetrate a front face 61 of the housing 60. A back plate 62 covers the open portion of the control, faces and lies adjacent the exterior side 56 of the door 24 upon installation.

The lever 28 is connected to an input cam 64 inside the housing 60. The input cam 64 is illustrated in detail in FIGS. 5 and 6. In the preferred embodiment, a shear pin 68, securely connected to the lever 28, engages a keyway 72 in the input cam 64. The shear pin 68 fits snugly into the keyway 72. The input cam 64 is substantially disk shaped with the above mentioned keyway 72 being contained on its inner portion, adjacent to a bore 76 through the disk. The periphery of the disk comprises two arcuate portions 80 and 84 of different diameter. This provides two cam lobes 88 and 92, one at each location where the different arcuate portions 80 and 84 meet.

Figure 3:
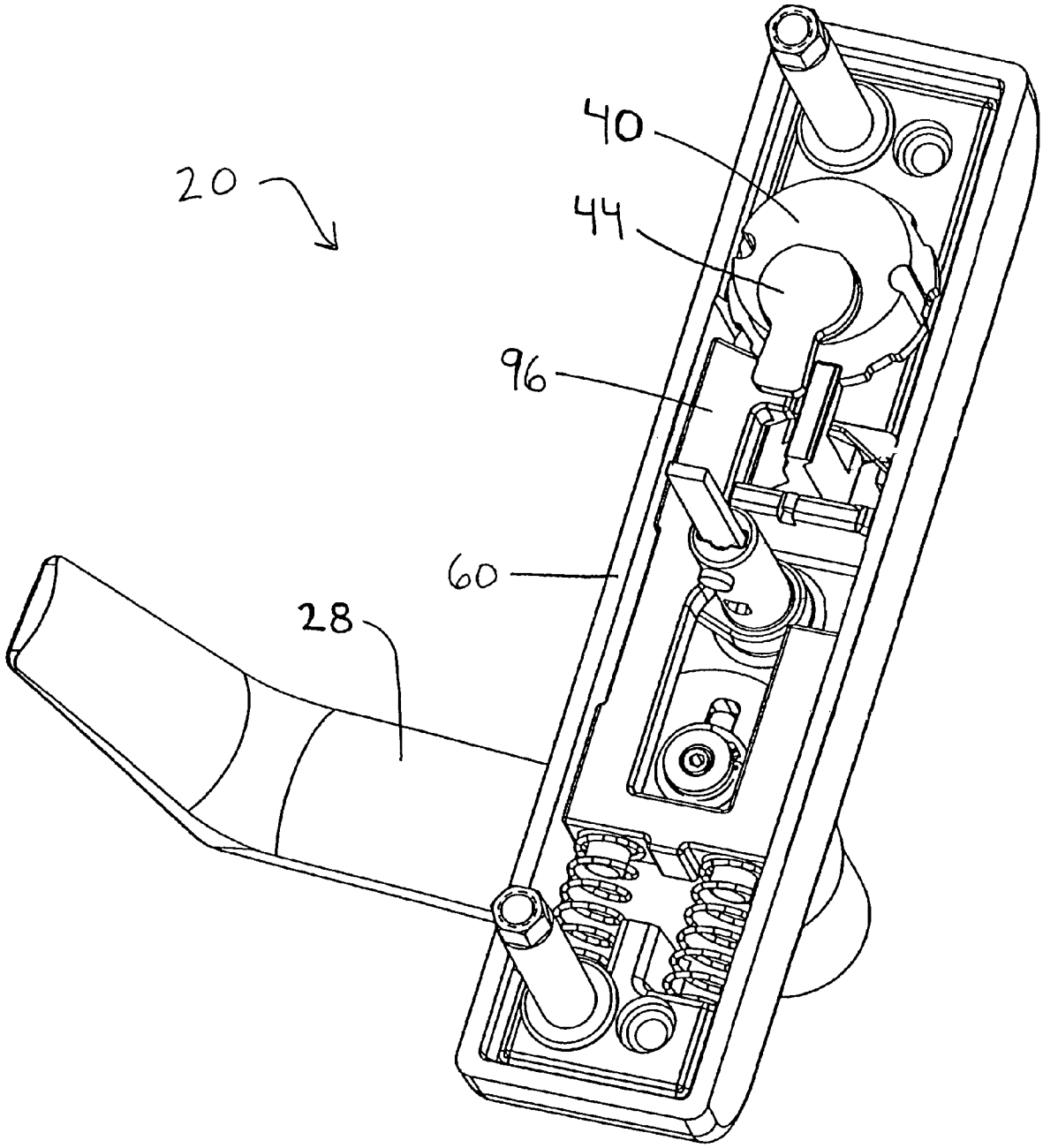
FIG. 3 is a perspective view of the control, which shows a key cylinder and a locking actuator within a housing.
Figure 4:
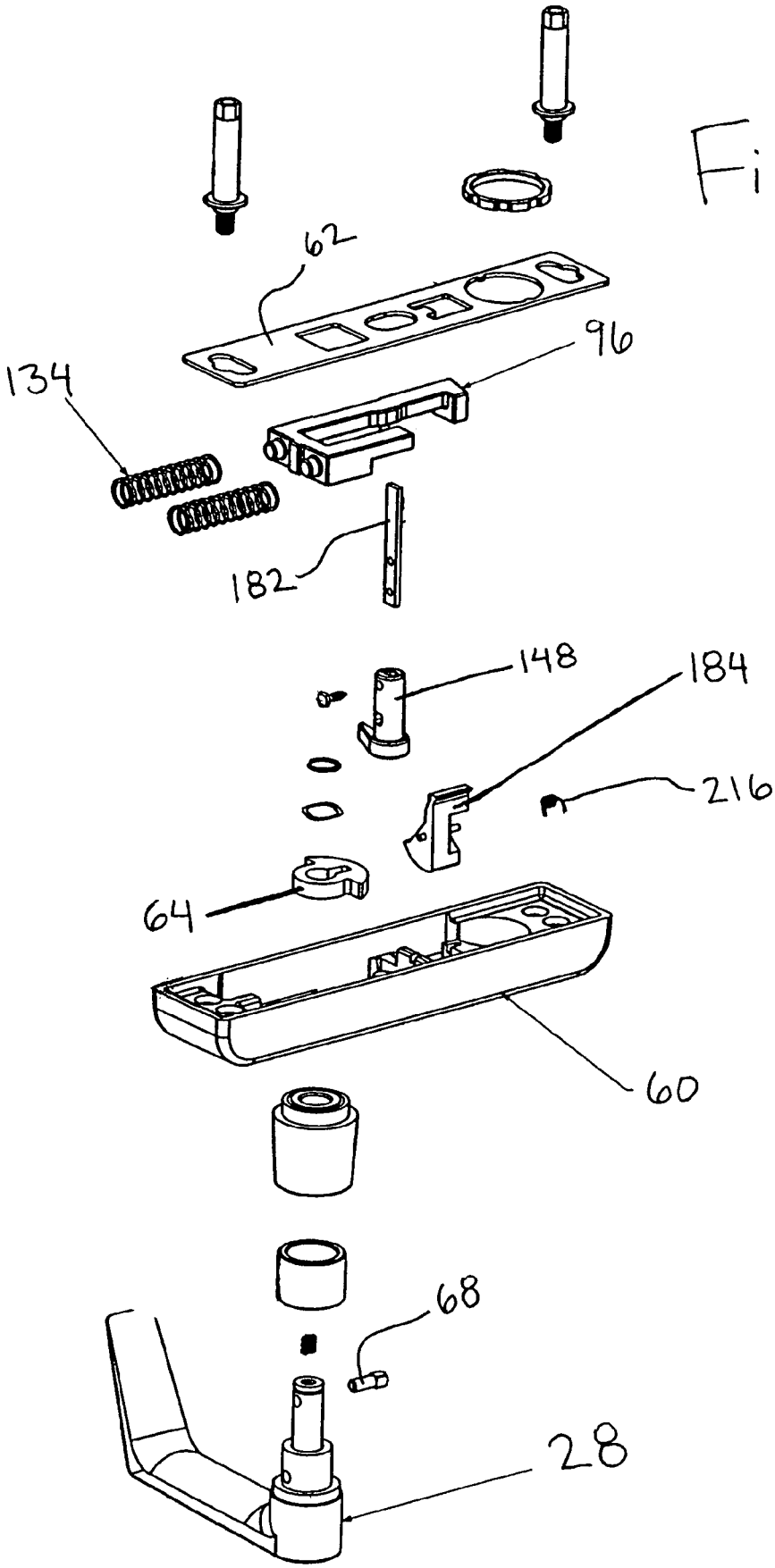
FIG. 4 is an exploded view of the control with key cylinder locking. The key cylinder is not shown for clarity.

As shown in FIGS. 3 and 4, a slider 96 is contained within the control 20. Detailed drawings of the slider 96 are provided in FIGS. 7 and 8. The slider 96 is basically shaped as a reverse "J" as looked upon in the front view. The slider 96 has a first upright portion 100 which is longer than a second upright portion 104. At the top of the first upright portion is a locking portion 108. The locking portion provides a locking face 112. The locking portion of the slider 96 has a thickness greater than a primary thickness 114 found at other locations on the slider 96. A second area 116 of the slider 96 has similar thickness, greater than the primary thickness 114. Where the second area of increased thickness 116 meets the primary thickness 114 are provided two cam follower faces 120 and 124 that face upward for contacting the lobes 88 and 92 of the input cam 64. On the bottom face 128 of the slider 96 are two spring locator pins 132. The locator pins 132 hold a pair of bias springs 134 in place. A protruding stop 136 is located on the bottom face 128 of the slider 96 between the spring locator pins 132. A slider output pin 140 extends from the back face 144 of the slider 96.

Figure 9:
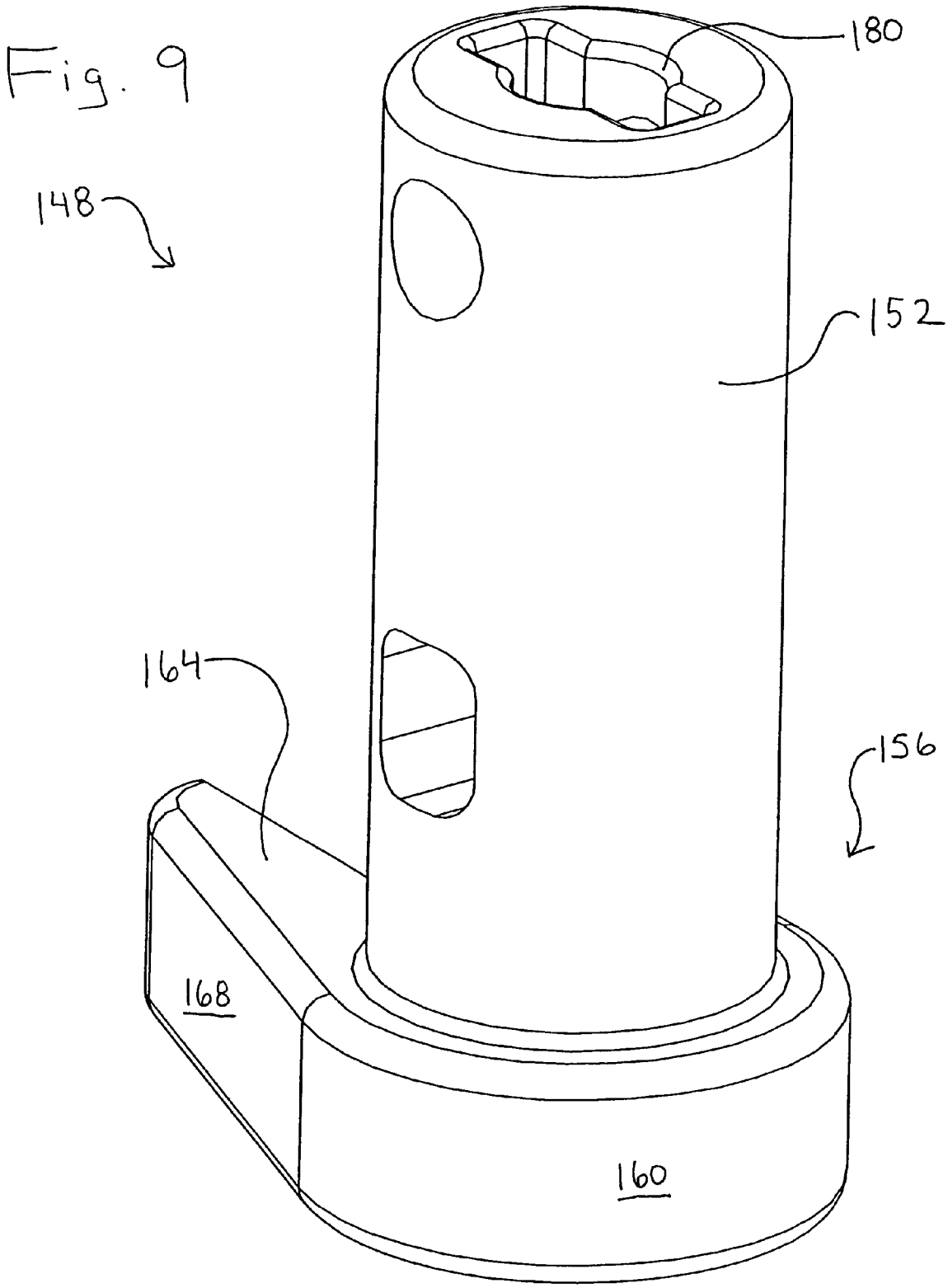
FIG. 9 is a perspective view of an output cam used in the control.
Figure 10:
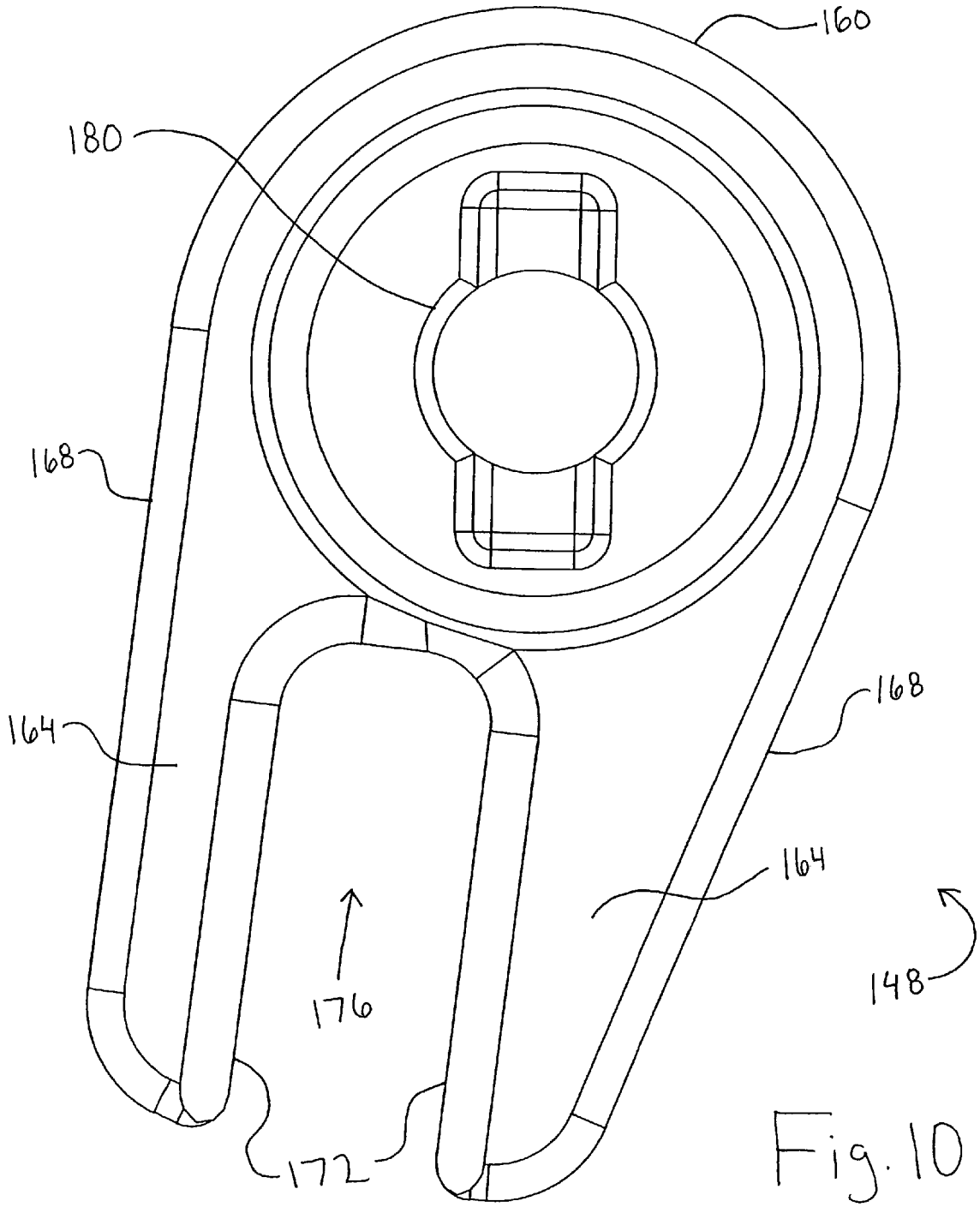
FIG. 10 is a front view of the output cam.

FIGS. 9 and 10 show an output cam 148 in detail. The output cam body 152 is cylindrical with a protruding cam lobe 156 at its base. The lobe 156 consists of a cylindrical portion 160 with an outer diameter greater than that of the body 152 and two extensions 164. The extensions 164 each have outer faces 168 tangential to the cylindrical portion 160, and have inner faces 172 that are parallel to each other, forming an open slot 176. The slot 176 is sized to fit closely around the slider output pin 140. The output cam 148 is mounted to the housing 60, allowing for rotation relative to the housing 60 about the longitudinal axis of the cylindrical body 152. In the cylindrical cam body 152 is an opening 180 to accept a common tailpiece 182. The tailpiece 182 is considered the output of the control 20 and interacts directly with the centercase of the exit device 36 to retract the latchbolt 32. In the preferred embodiment, the output cam 148 is centrally located within the control 20 to match a centrally located centercase input located in the exit device 36.

FIGS. 11-14 show details of a swivel locking latch 184. The latch 184 consists of a main body 188 and a pin 192. The main body 188 has a head 196 with a first actuation surface 200, a second actuation surface 202, and an arcuate bottom 204. The arcuate bottom 204 has a blocking surface portion 212. When the control 20 is assembled, the pin 192 carries a torsion spring 216 (seen in FIGS. 4 and 15) with a first extending prong 220 and a second extending prong 224. The first prong 220, abuts a recessed spring face 226 of the swivel locking latch 184. When the control 20 is assembled with the back plate 62, the second prong 224 abuts the back plate 62. The pin 192 is held by the housing 60 such that the latch 184 is rotatable about an axis perpendicular to an axis of rotation of the key cylinder actuator lever 44.

In a preferred embodiment, the swivel locking latch body 188 is formed without the pin 192. A hole is drilled in the body 188 and the pin 192 is pressed into the hole for a tight fit. Further, in this embodiment, the body 188 is formed by compacting powdered metal and baking it at a temperature below the melting temperature to form strengthening bonds within the material. This method represents the preferred embodiment of the invention, but it is readily apparent to those skilled in the art that the latch 184 and latch body 188 may be formed in other manners. Various materials may be used, metallic and non-metallic, and the pin 192 may be formed integrally with the body 188 rather than pressed in, affording that the end result is a latch 184 with adequate strength.

Figure 11:
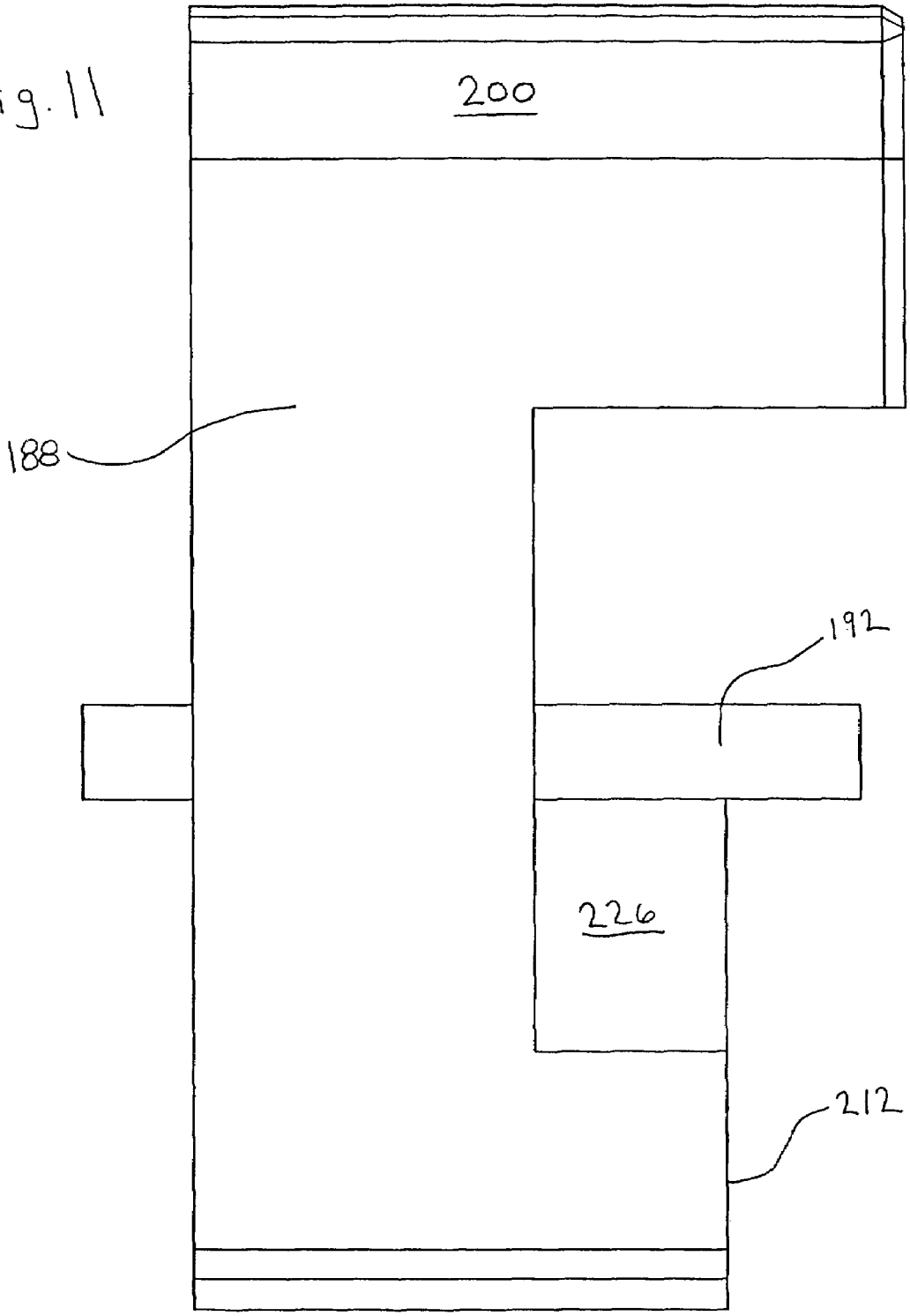
FIG. 11 is front view of a swivel locking latch used in the control.
Figure 12:
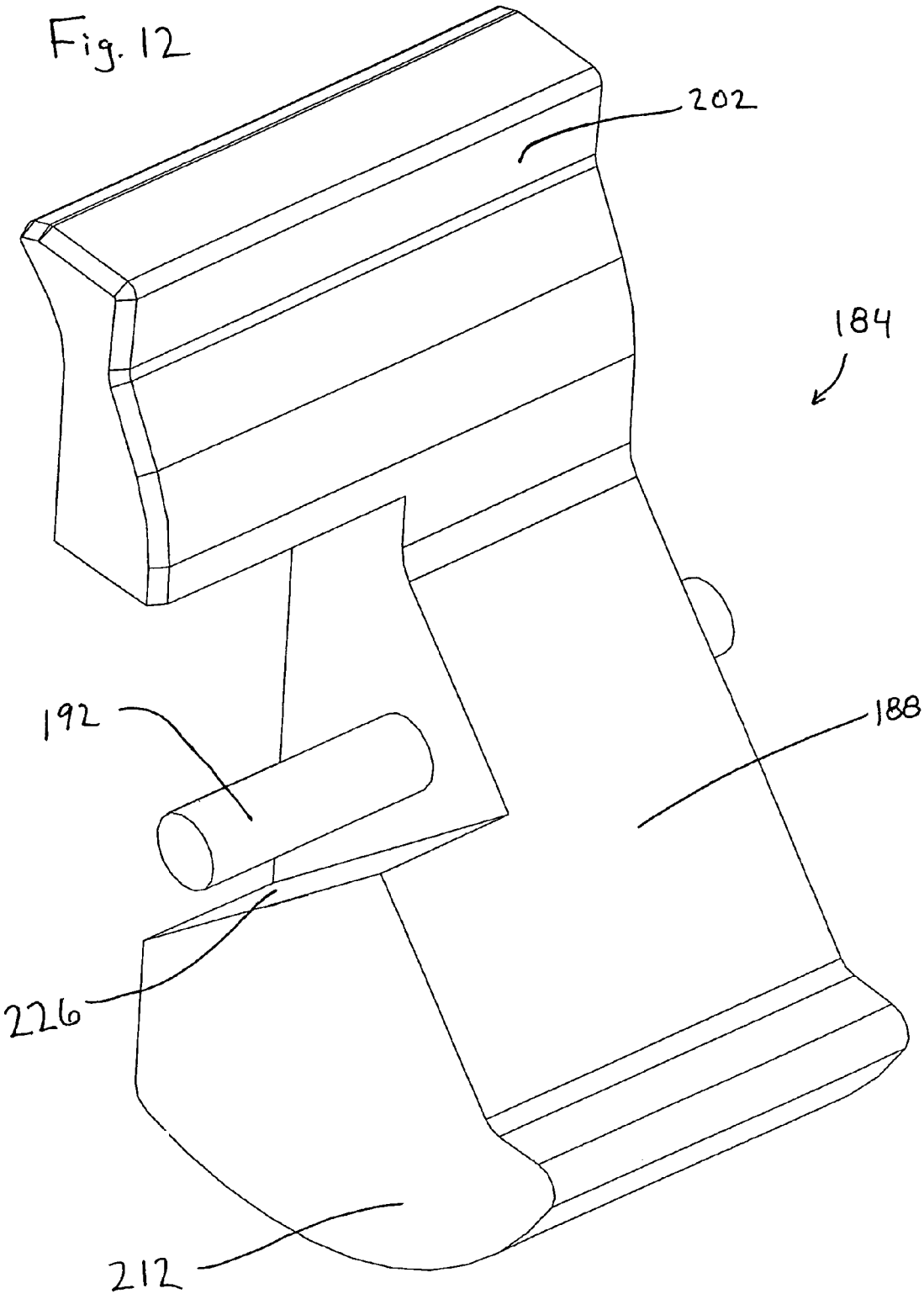
FIG. 12 is a perspective view of the swivel locking latch.
Figure 13:
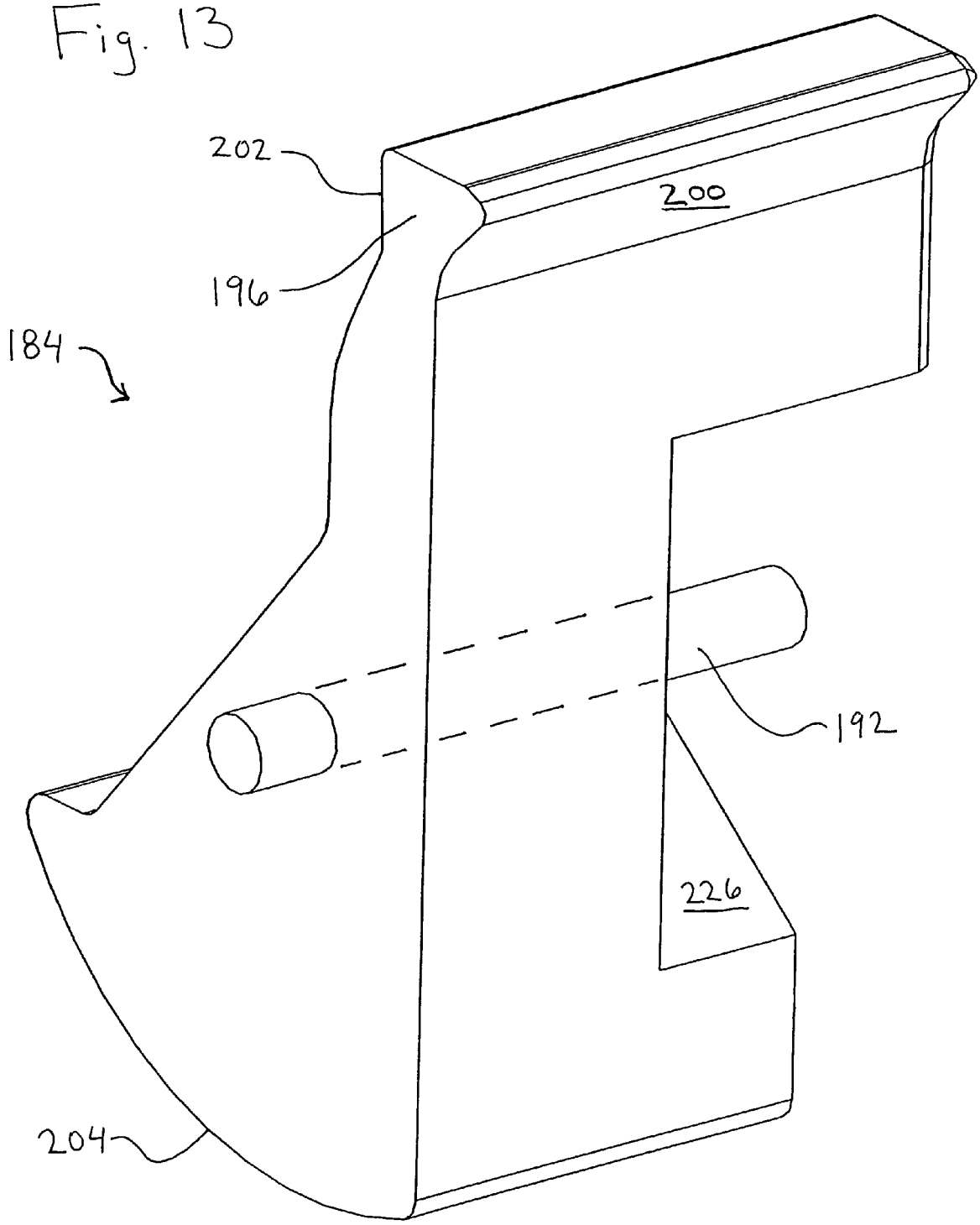
FIG. 13 is an alternate perspective view of the swivel locking latch.
Figure 14:
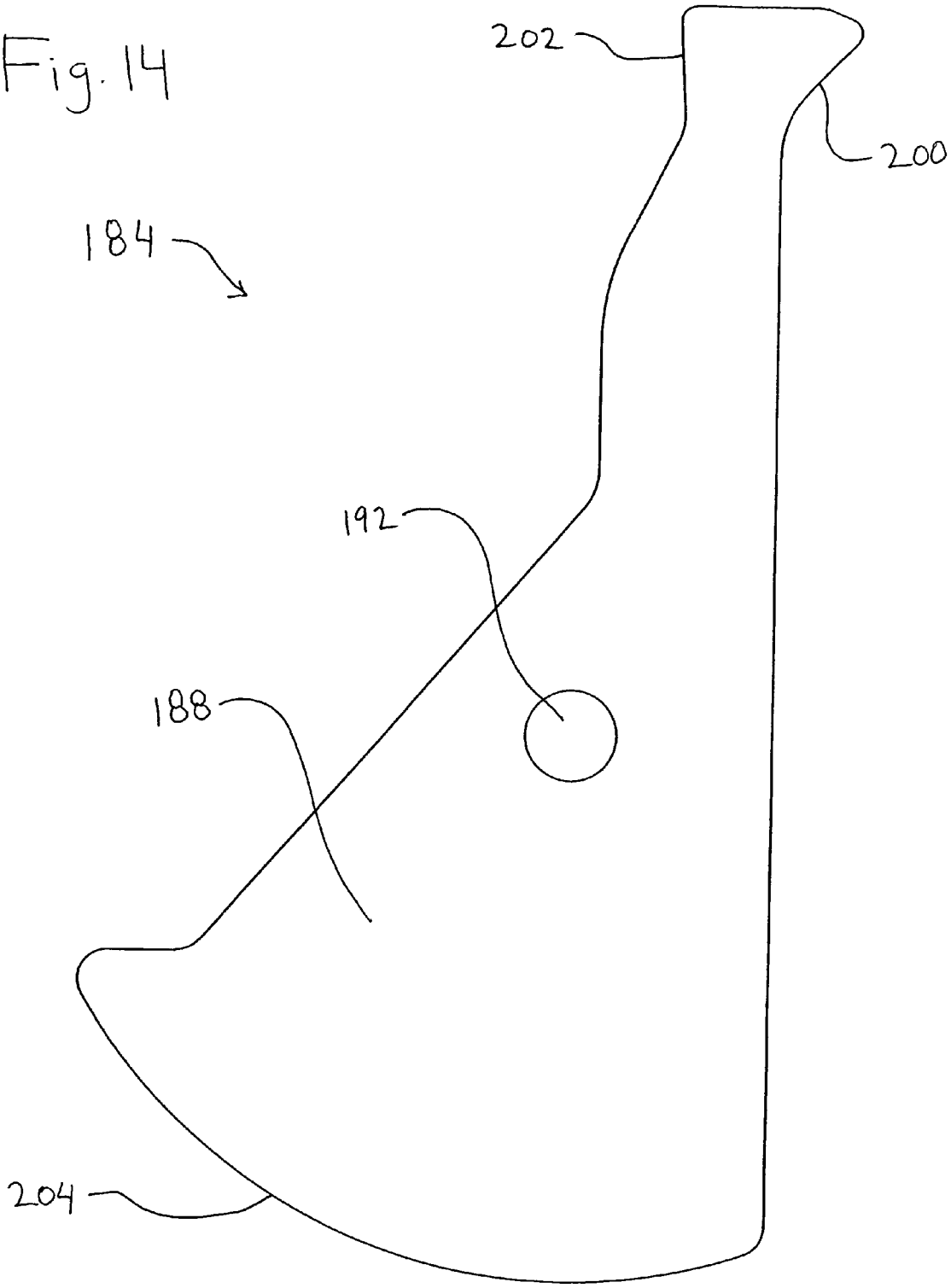
FIG. 14 is a side view of the swivel locking latch.
Figure 15:
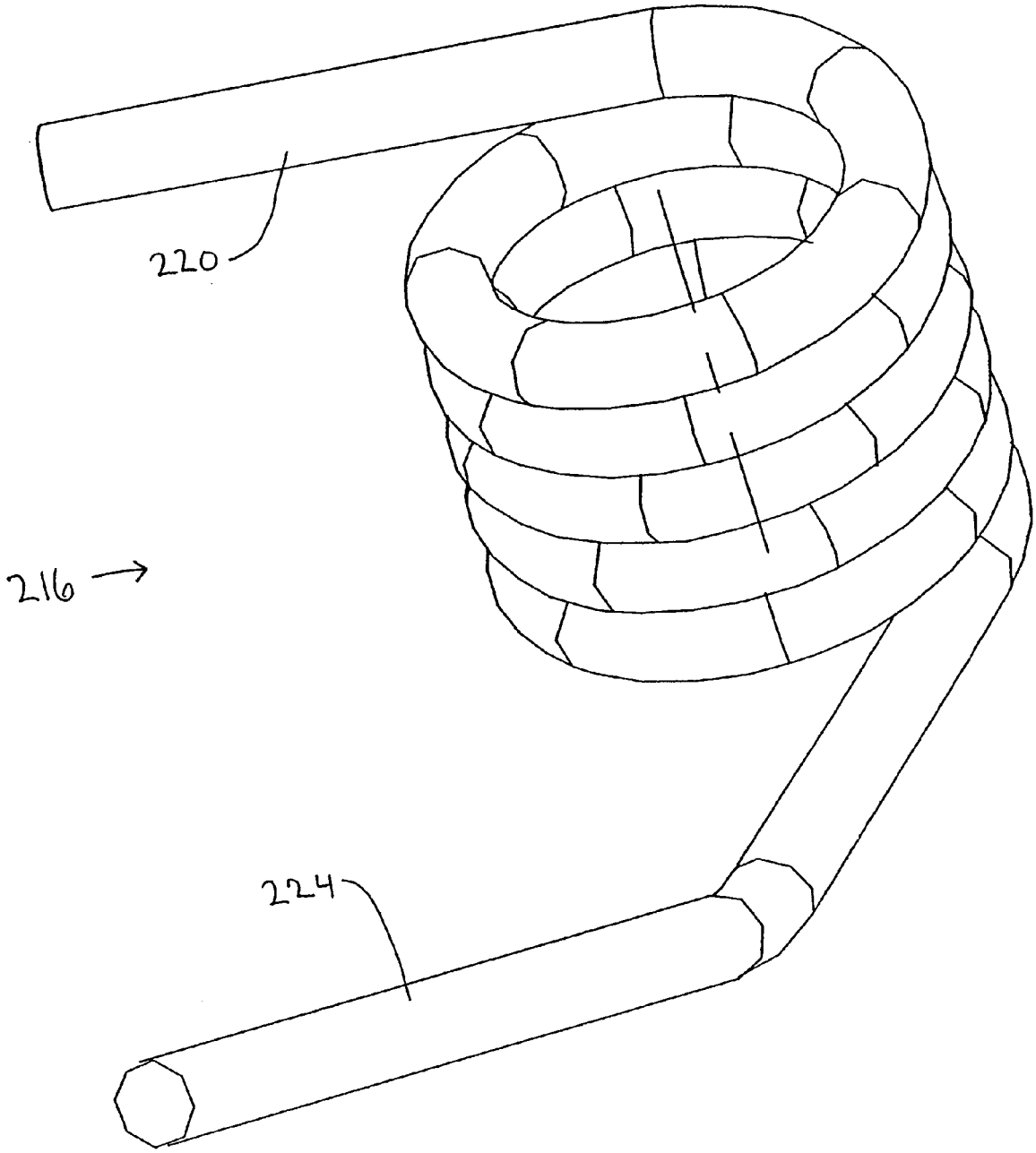
FIG. 15 is a perspective view of a torsion spring used in the control.
Figure 16:
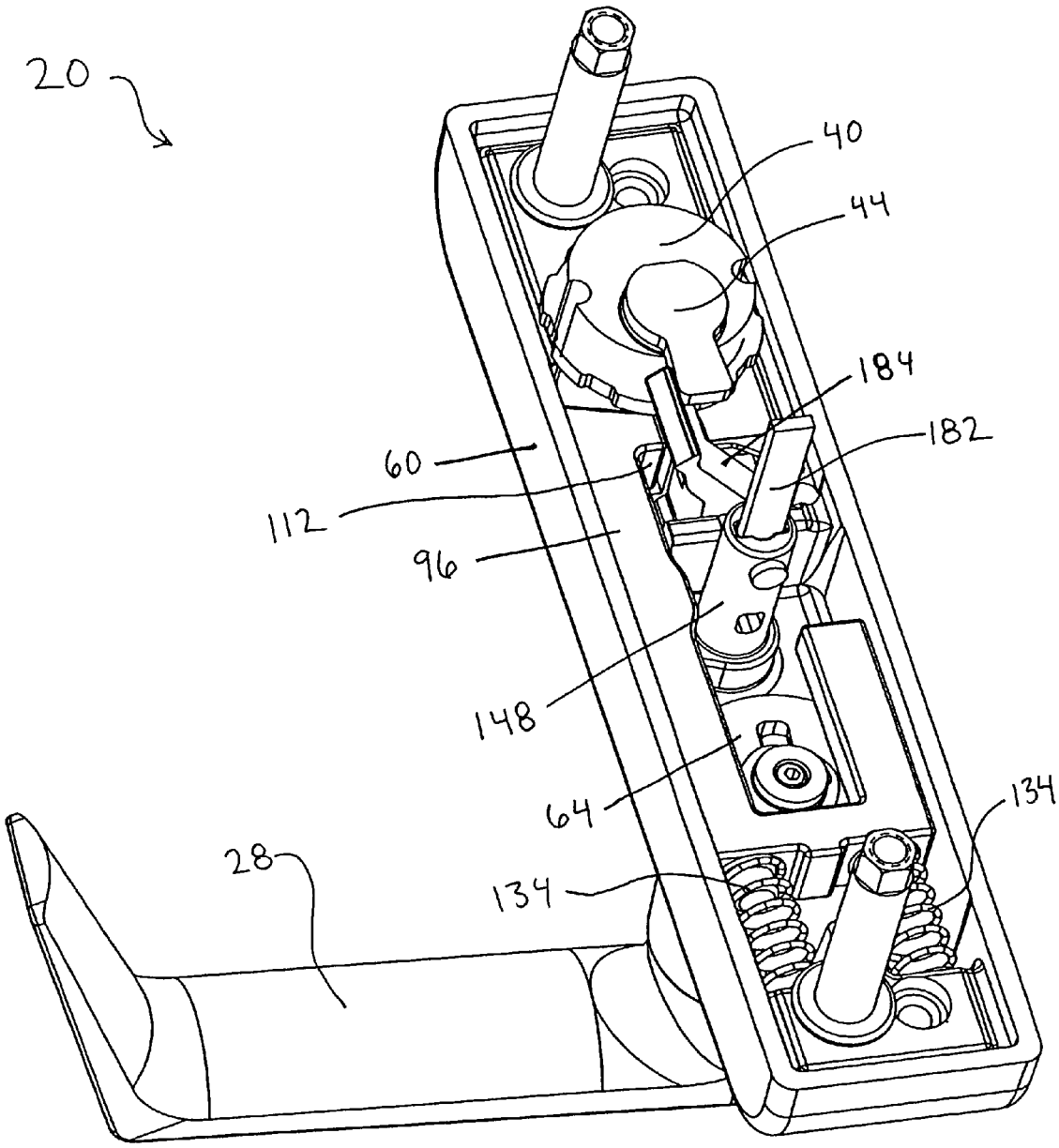
FIG. 16 is a perspective view of the control in an unlocked and inactivated state.
Figure 17:
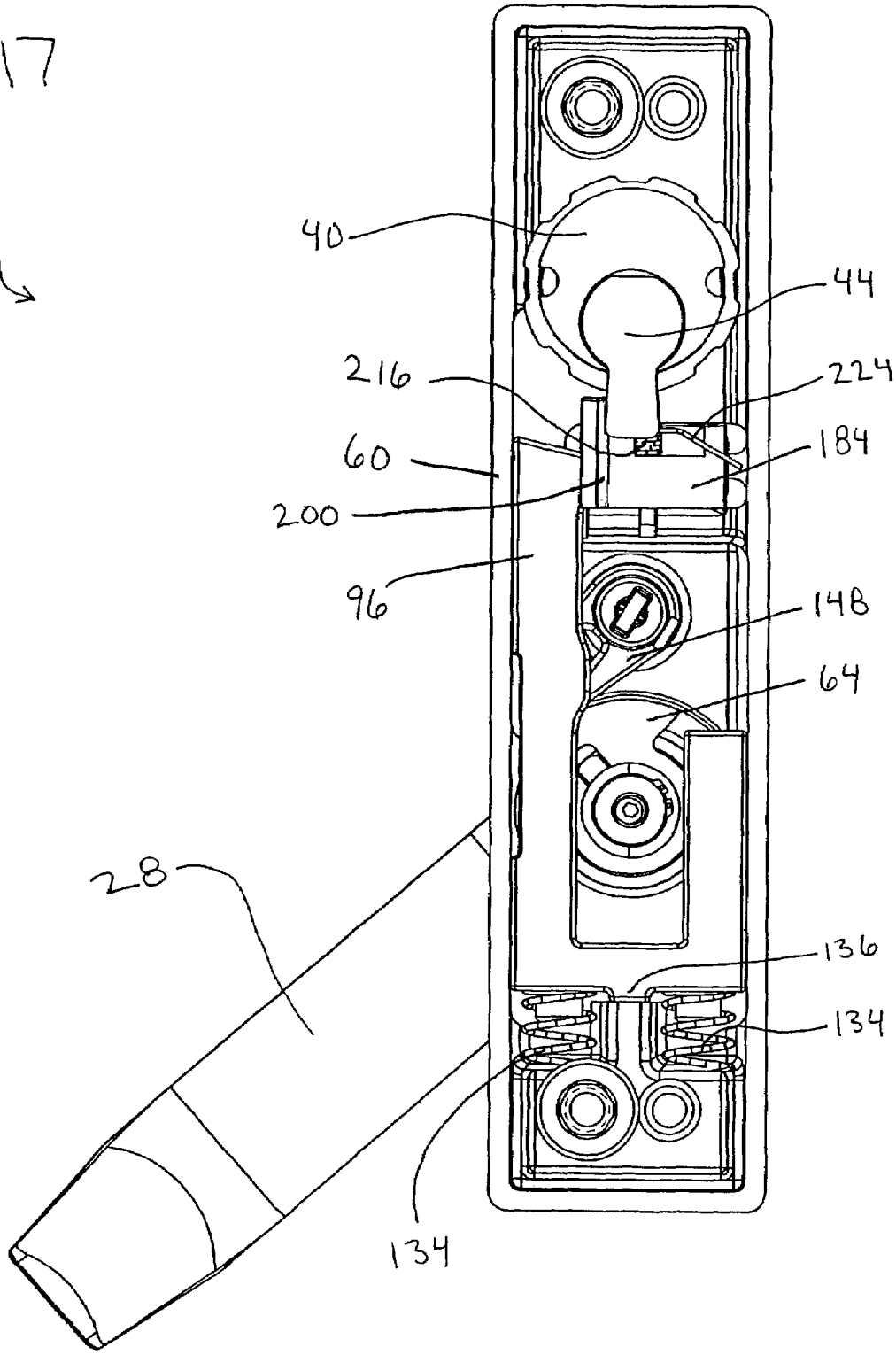
FIG. 17 is a perspective view of the control in the unlocked state, being activated with a downward motion of the lever.
Figure 18:
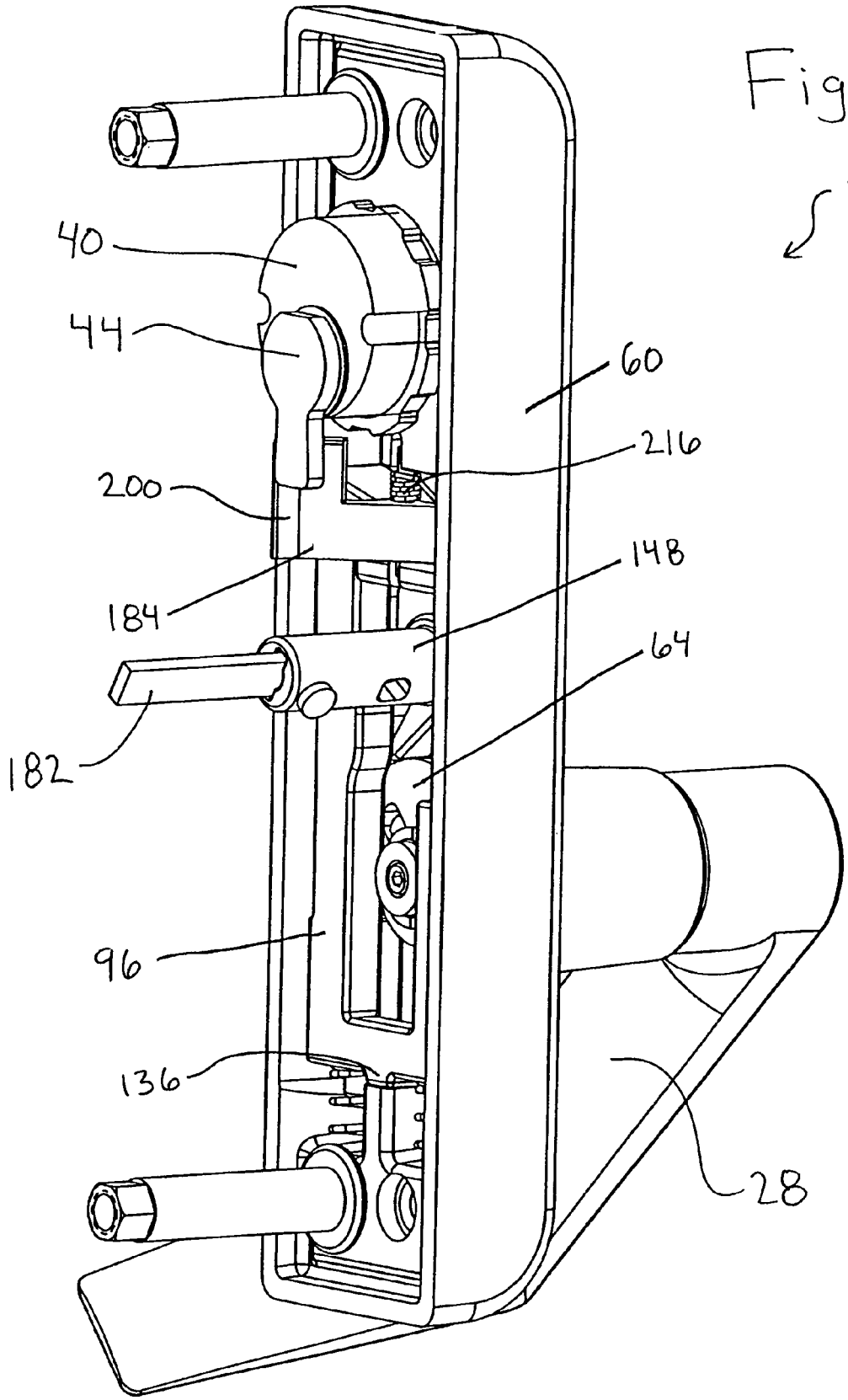
FIG. 18 is an alternate perspective view of the control in the unlocked state, being activated with a downward motion of the lever.
Figure 19:
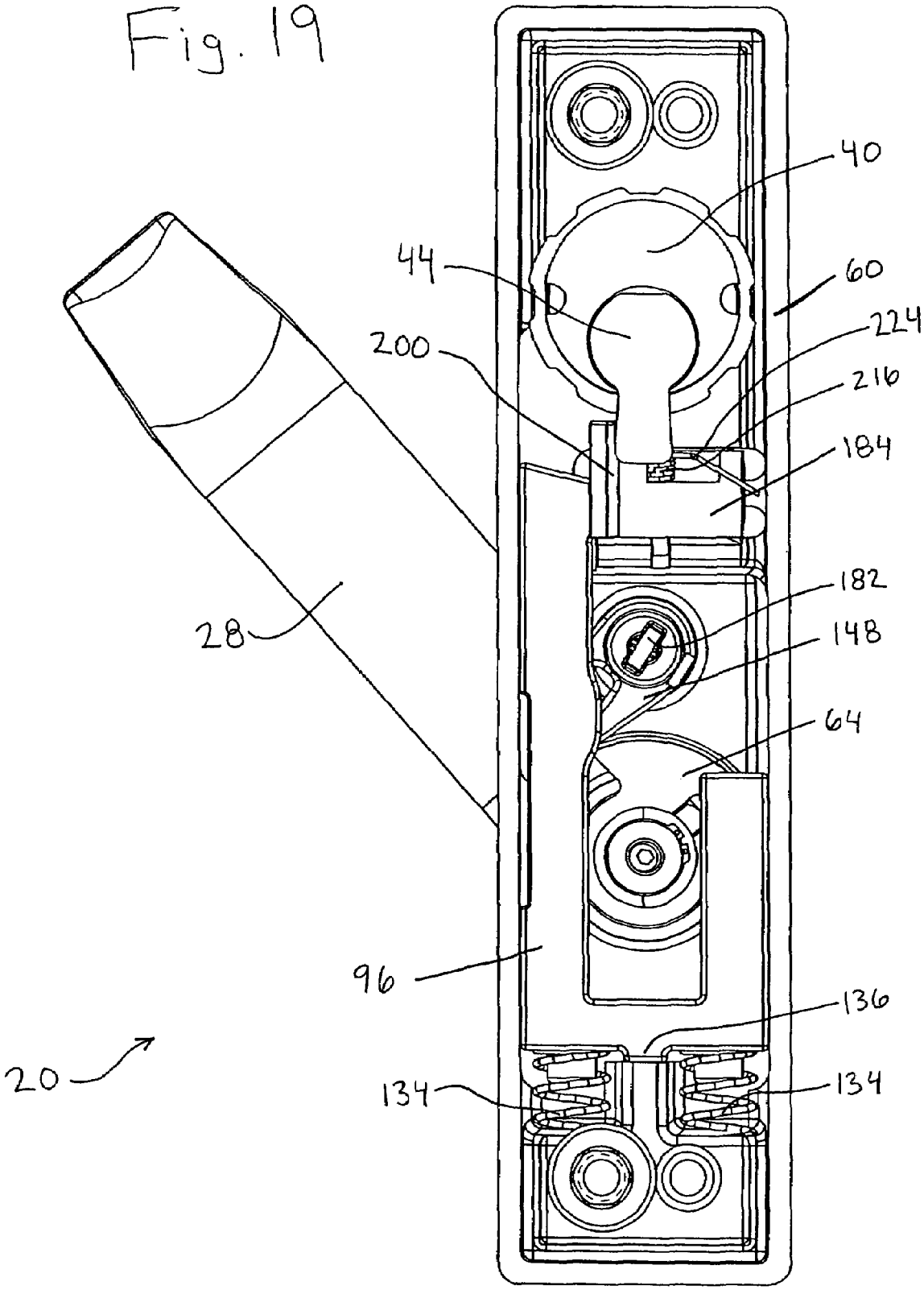
FIG. 19 is a back view of the control in the unlocked state, being activated with an upward motion of the lever.
Figure 20:
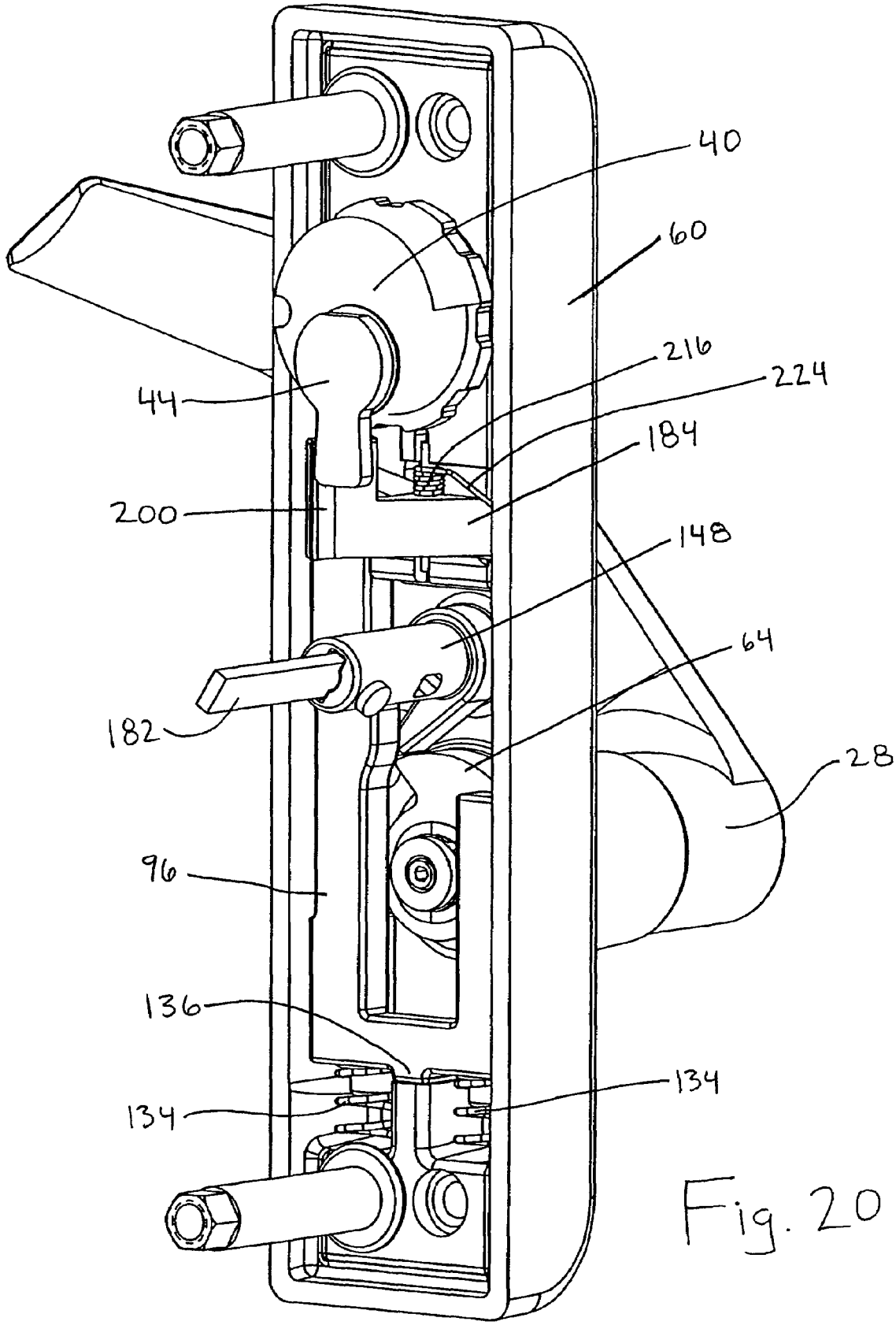
FIG. 20 is a perspective view of the control in the unlocked state, being activated with an upward motion of the lever.

FIG. 16 illustrates the control 20 in an unlocked, inactivated state. The unlocked state of the control 20 is defined as the condition in which the swivel locking latch 184 is in an unlocked position, with the blocking surface portion 212 (as shown in FIG. 12) free of the path of the slider 96. The actuator lever 44 of the key cylinder 40 is in an unlocked position, contacting the first actuation surface 200 (as shown in FIG. 13) and holding the swivel locking latch 184 in the unlocked position. The prongs 220 and 224 of the torsion spring 216 (as shown in FIG. 15) are forced toward each other while the latch 184 is in the unlocked state, causing the spring 216 to provide a slight resistive force to the recessed spring face 226 (as shown in FIGS. 11, 12 and 13) of the latch 184. In the inactivated state, the lever 28 is not receiving a user input and thus, the input cam 64 is in a neutral position, allowing the slider 96 to maintain an upward position, supported by the uncompressed bias springs 134. In this state, the latchbolt 32 (as shown in FIG. 1) is in an extended position.

Figure 2:
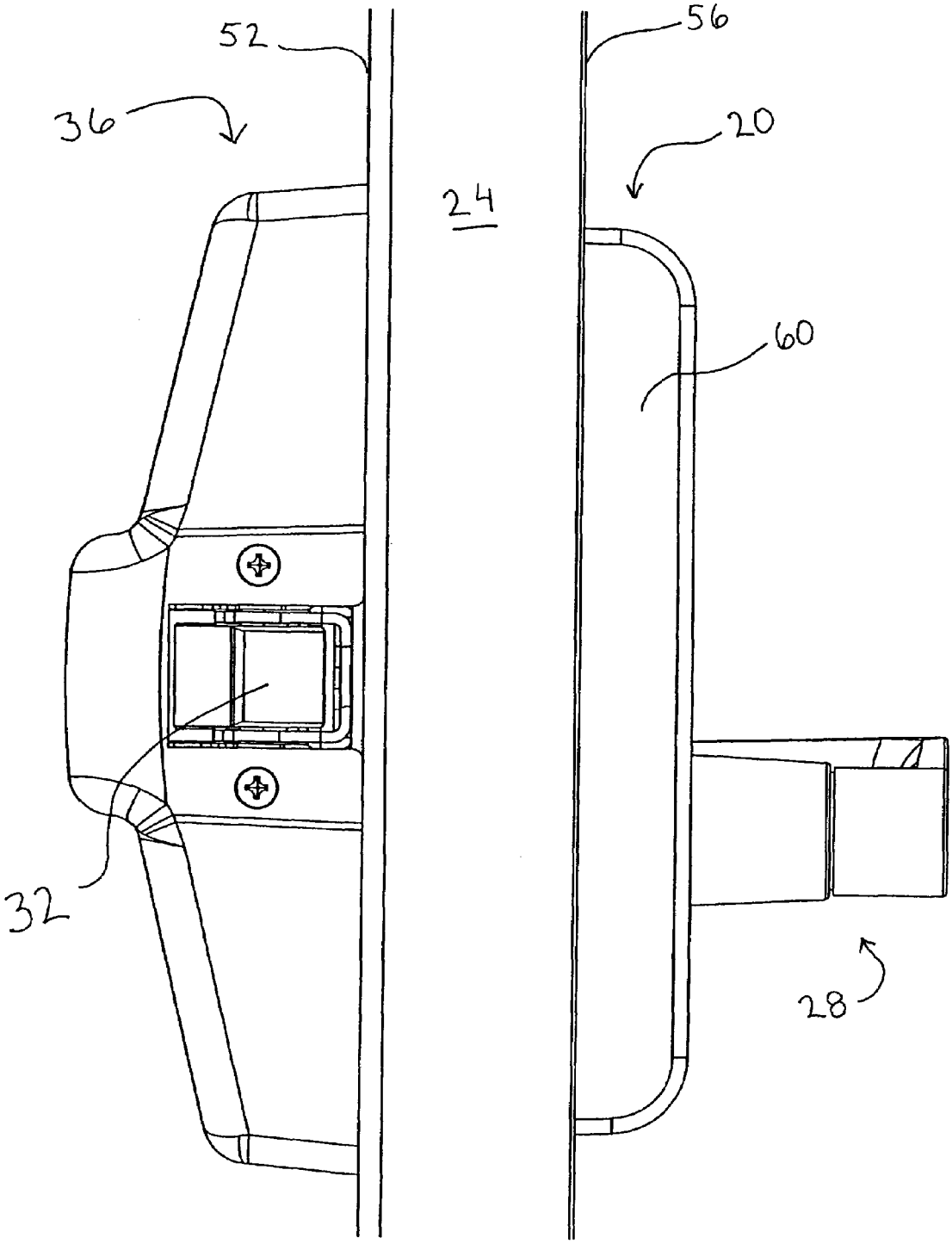
FIG. 2 is a side view of the control and exit device installed on the narrow stile door.
Figure 7:
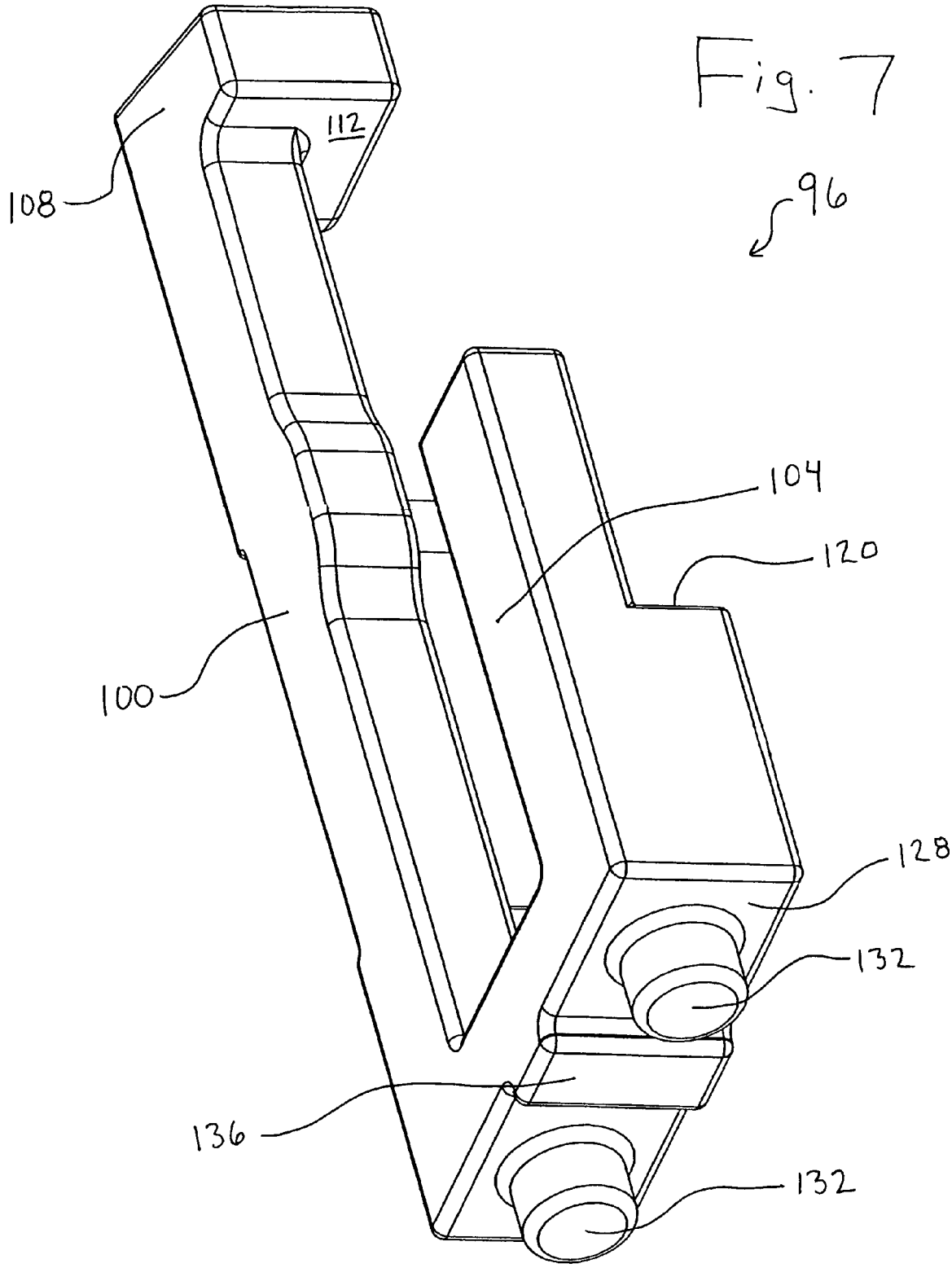
FIG. 7 is a perspective view of a slider used in the control.
Figure 8:
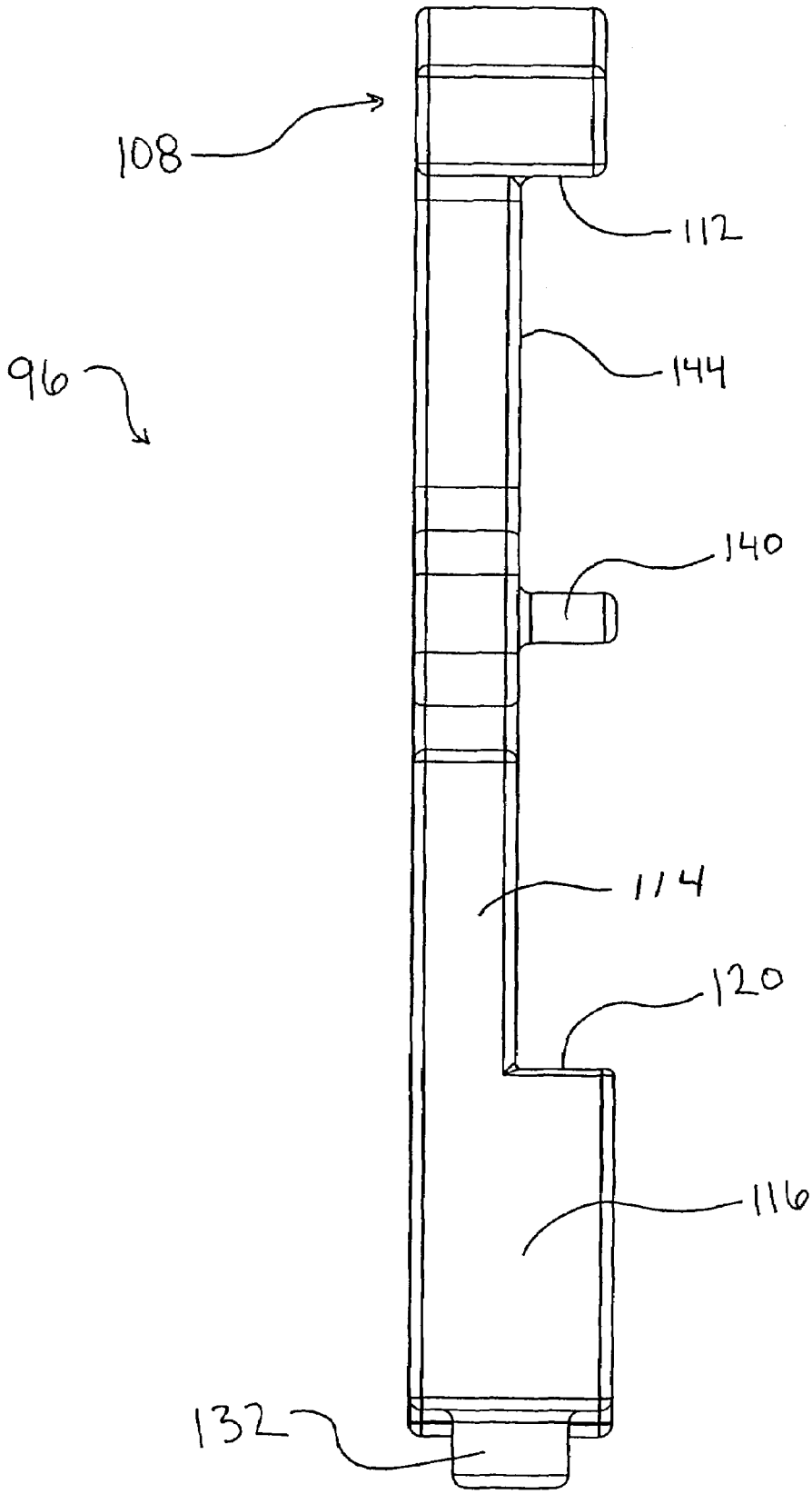
FIG. 8 is a side view of the slider.

In the unlocked state, the control 20 must be capable of providing a torque and transmitting a corresponding rotational motion to the centercase upon receiving an input motion (e.g. rotation of the lever 28). FIGS. 17-20 illustrate the control 20 in an unlocked and activated state. In the activated state, the lever 28 is receiving a user input, being rotated in either of two allowable directions. The input cam 64 rotates with the lever 28 into an activated position, contacting one of the cam follower faces 120 (as shown in FIGS. 7 and 8) of the slider 96 and eventually forcing the slider 96 into a downward position against the resilient force of the bias springs 134 until the protruding stop 136 contacts the housing. The slider output pin 140 (as shown in FIG. 8) imposes a uni-directional rotation on the output cam 148 by applying a downward force to the inner face 172 (as shown in FIG. 10). The output cam 148 carries, within the tailpiece opening 180 (as shown in FIGS. 9 and 10), the tailpiece 182, which directly engages the input to the centercase to withdraw the latchbolt 32 (as shown in FIGS. 1 and 2). With the latchbolt 32 withdrawn, the door 24 may be opened.

Figure 21:
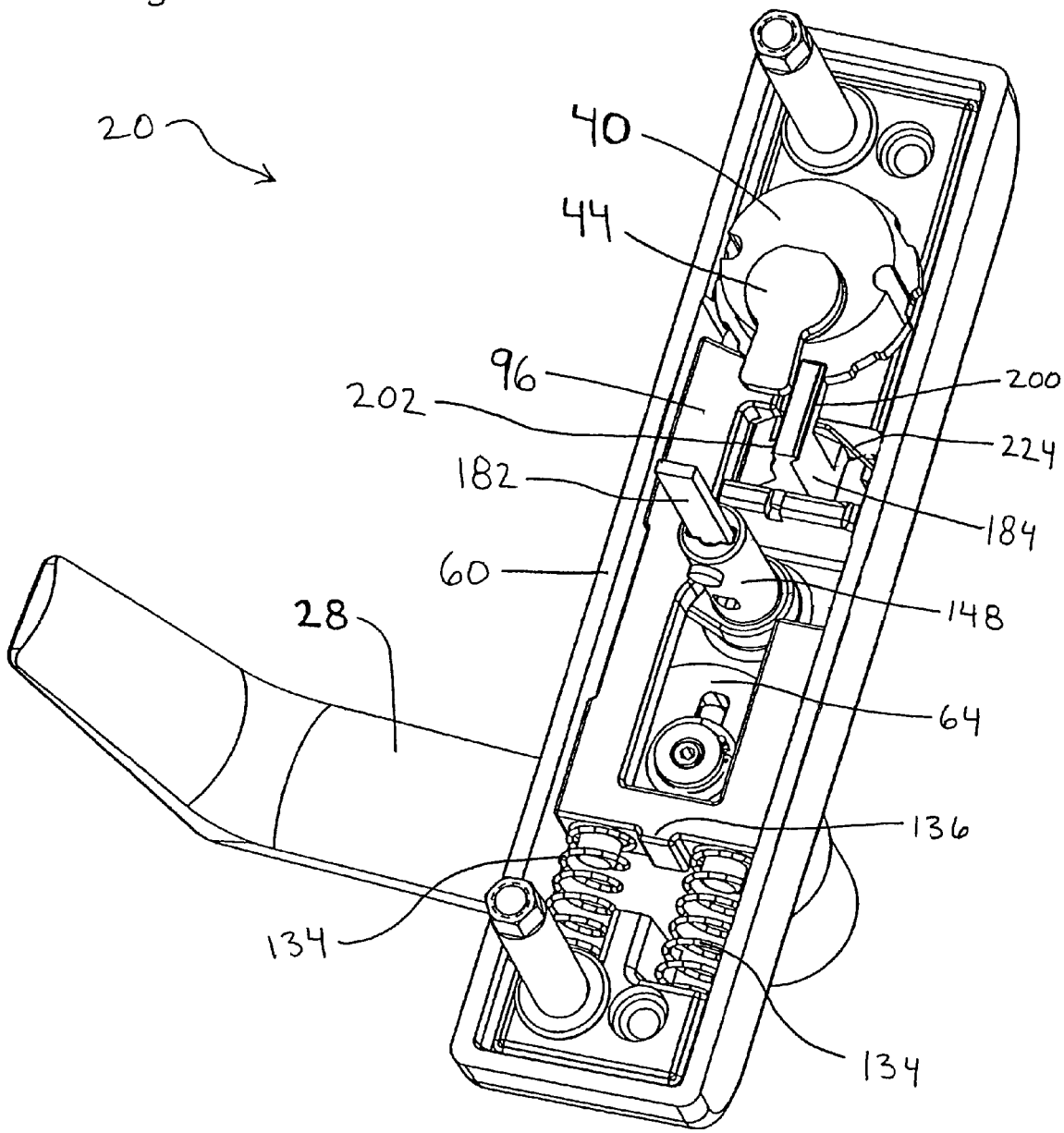
FIG. 21 is a perspective view of the control in a locked state with the key cylinder actuator lever in the locked position.
Figure 22:
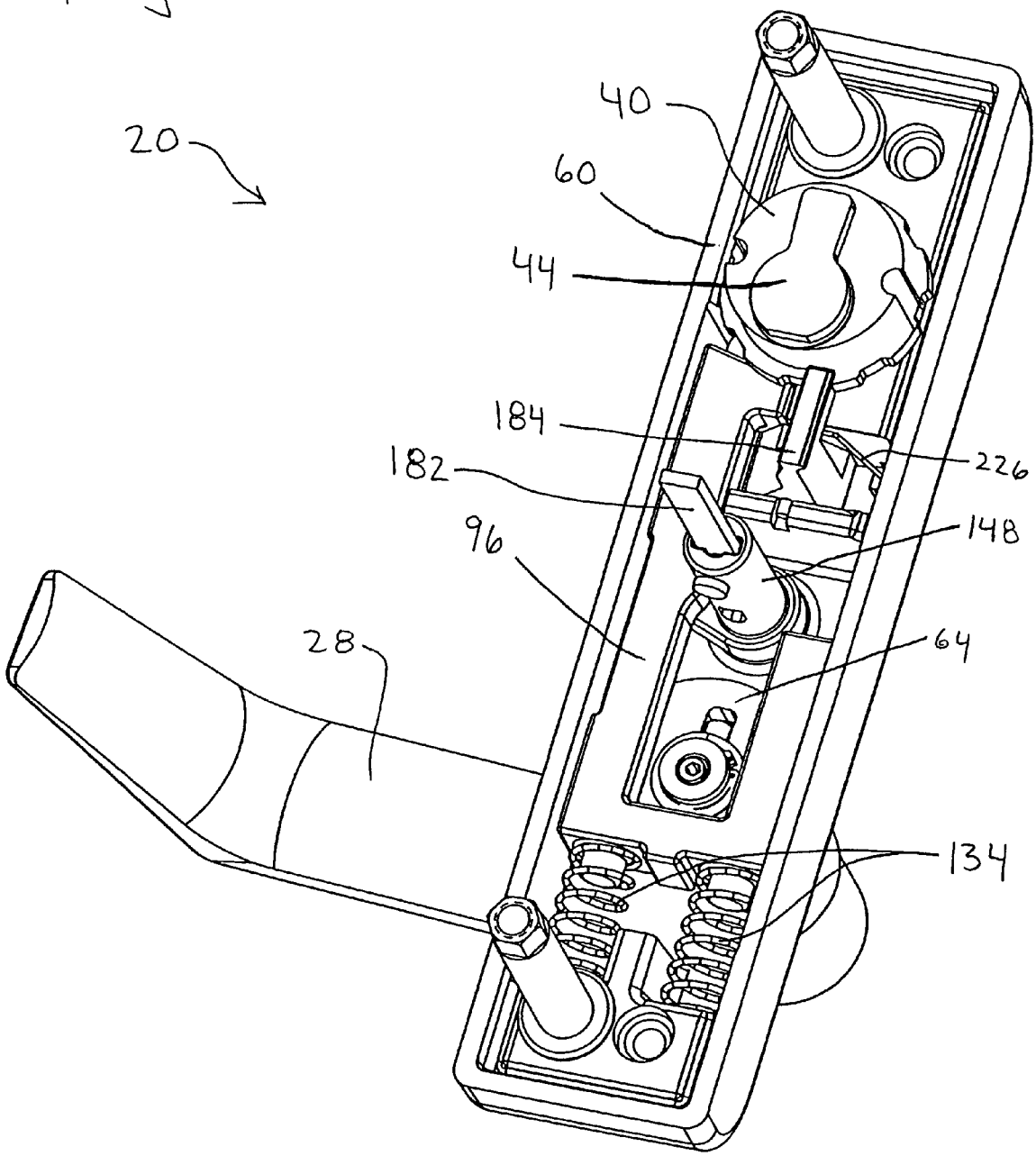
FIG. 22 is a perspective view of the control in a locked state with the key cylinder actuator lever in the mid-turn.

FIG. 21 illustrates the control 20 in a locked state. To put the control 20 into the locked state from the unlocked state, the key cylinder actuator lever 44 is rotated about the axis of the key cylinder 40 (counter-clockwise as viewed from FIG. 19). Rotation of the actuator lever 44 takes place by insertion and twisting of a key. As the actuator lever 44 rotates counter-clockwise, the force applied to the recessed spring face 226 (as shown in FIGS. 11, 12 and 13) by the torsion spring 216 (as shown in FIG. 4) becomes enabled to rotate the swivel locking latch 184 out of the unlocked position, causing the latch 184 to rotate immediately into the locked position as soon as the actuator lever 44 rotates out of contact with actuation surface 200. The actuator lever 44 continues to rotate and eventually contacts the second actuation surface 202 of the swivel locking latch 184 for positive locking. In this state, the control 20 is fully locked, preventing the door 24 from being opened with the lever 28. FIG. 22 shows the actuator lever 44 in mid-turn. The swivel locking latch 184 is in the locked position due to the force of torsion spring 216 (as shown in FIG. 4). The invention should not be considered to require both the torsion spring 216 and the positive locking of actuator lever 44 as one or the other is sufficient to provide a locked state for the control 20. A preferred embodiment includes both, as it is the preference of the inventors to provide a control 20 with enhanced locking predictability.

The control 20 of the present invention allows two separate locking functions known in the art as ANSI function 08 and ANSI function 09. ANSI function 08 allows the key cylinder actuator lever 44 to rotate a full 360 degrees between locked and unlocked positions. When the actuator lever 44 is in the unlocked position, the key may be removed from the key cylinder 40, leaving the control 20 in the unlocked state. ANSI function 09 allows the actuator lever 44 to be rotated from the locked position, no more than approximately 359 degrees to unlock the control 20. The key may not be withdrawn from the key cylinder 40 until the actuator lever 44 returns to the locked position, returning the control 20 to the locked state. Both functions operate with the same swivel locking latch 184, slider 96, input cam 64, and output cam 148, the modification required to switch between the two functions being inclusive to the key cylinder 40.

Figure 5:
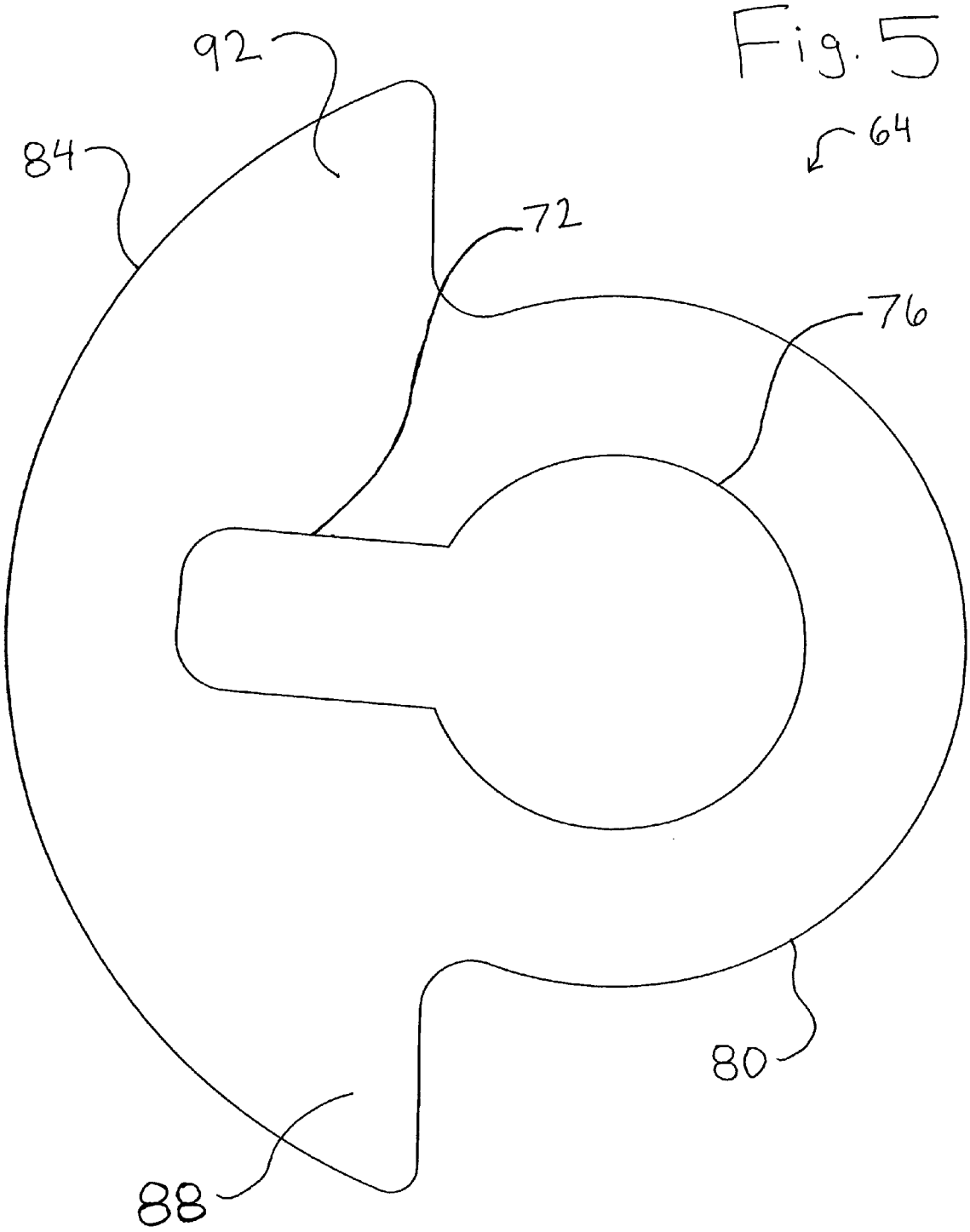
FIG. 5 is a front view of an input cam used in the control.
Figure 6:
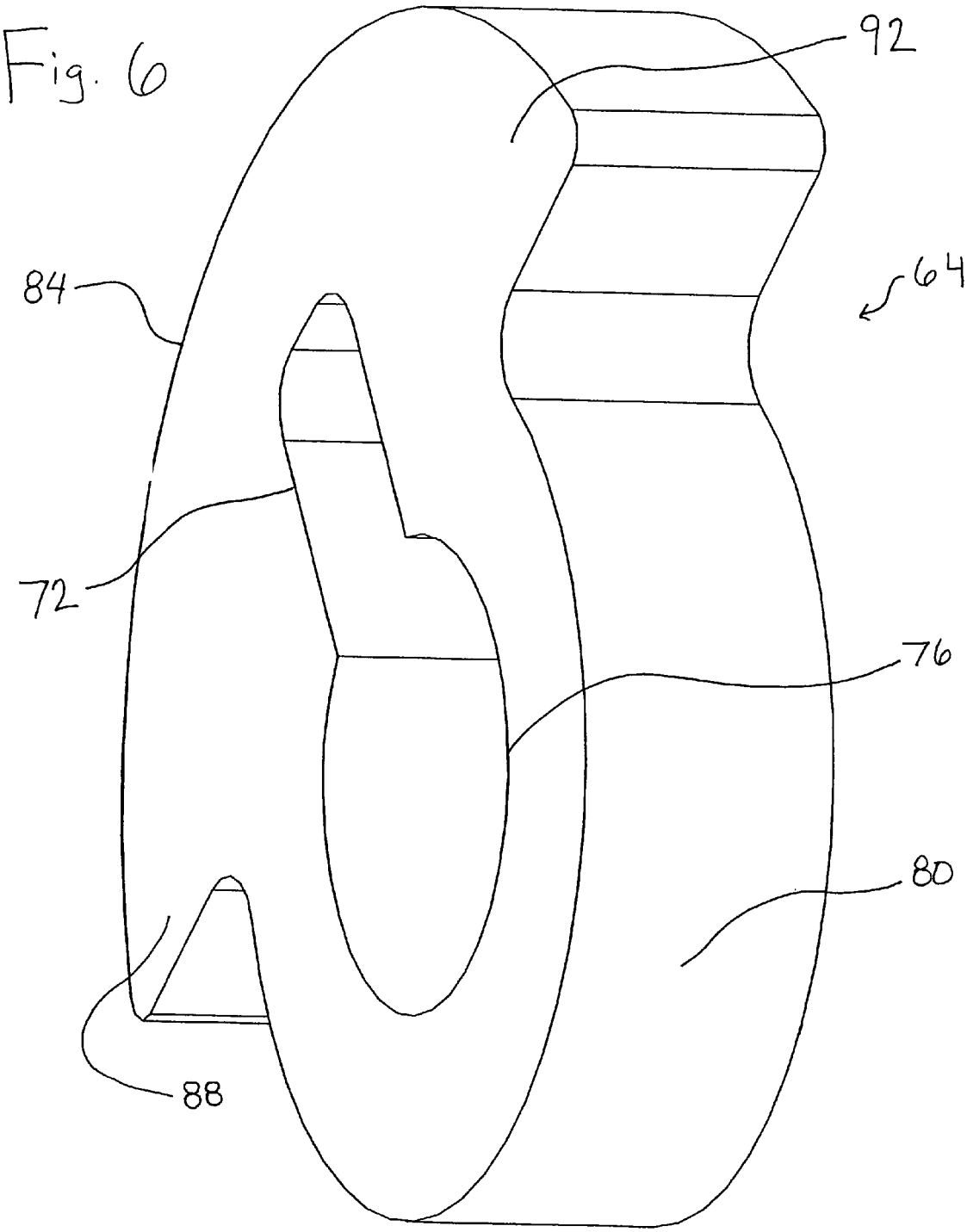
FIG. 6 is a perspective view of the input cam.

In the locked state, the control 20 opposes rotation of the lever 28. In the event that a force is imparted upon the lever 28, one of the input cam lobes 88 or 92 (as shown in FIGS. 5 and 6) applies a force to a cam follower face 120 (as shown in FIGS. 7 and 8) of the slider 96 (while remaining in the neutral position). Recalling that, in the locked state, the swivel locking latch 184 is rotated into the locked position, the locking face 112 of the slider 96 applies the force to the blocking surface portion 212 (as shown in FIG. 12). Therefore, the swivel locking latch 184 provides the requisite reactant force, preventing the slider 96 from leaving the upward position. Consequently, the slider 96 cannot attain the downward position and the output cam 148 remains in the neutral position. This leaves the latchbolt 32 (as shown in FIG. 1) in the extended position, and the door 24 cannot be opened.

Figure 23:
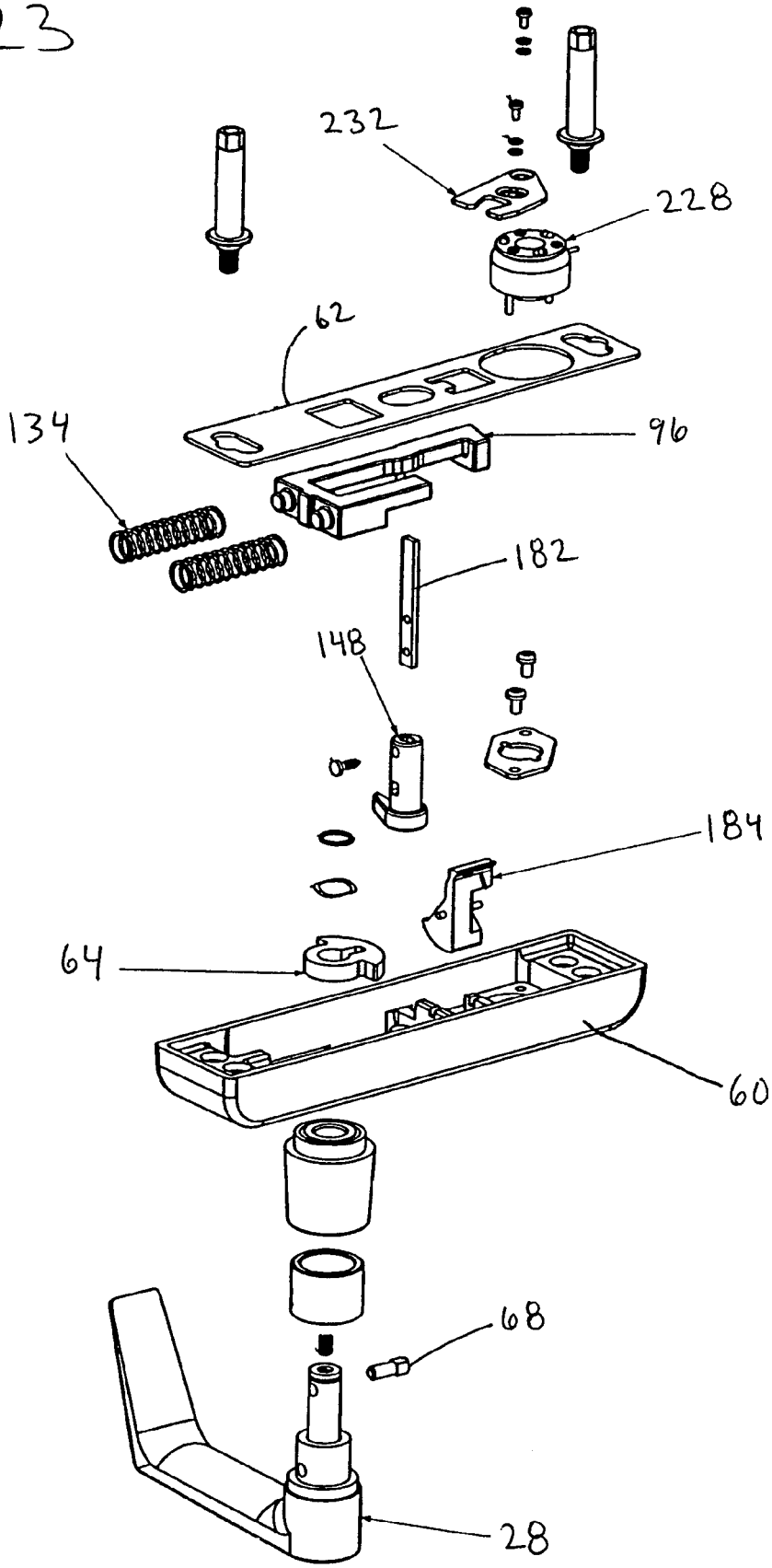
FIG. 23 is an exploded assembly view of the control with an electric solenoid in place of the key cylinder.
Figure 24:
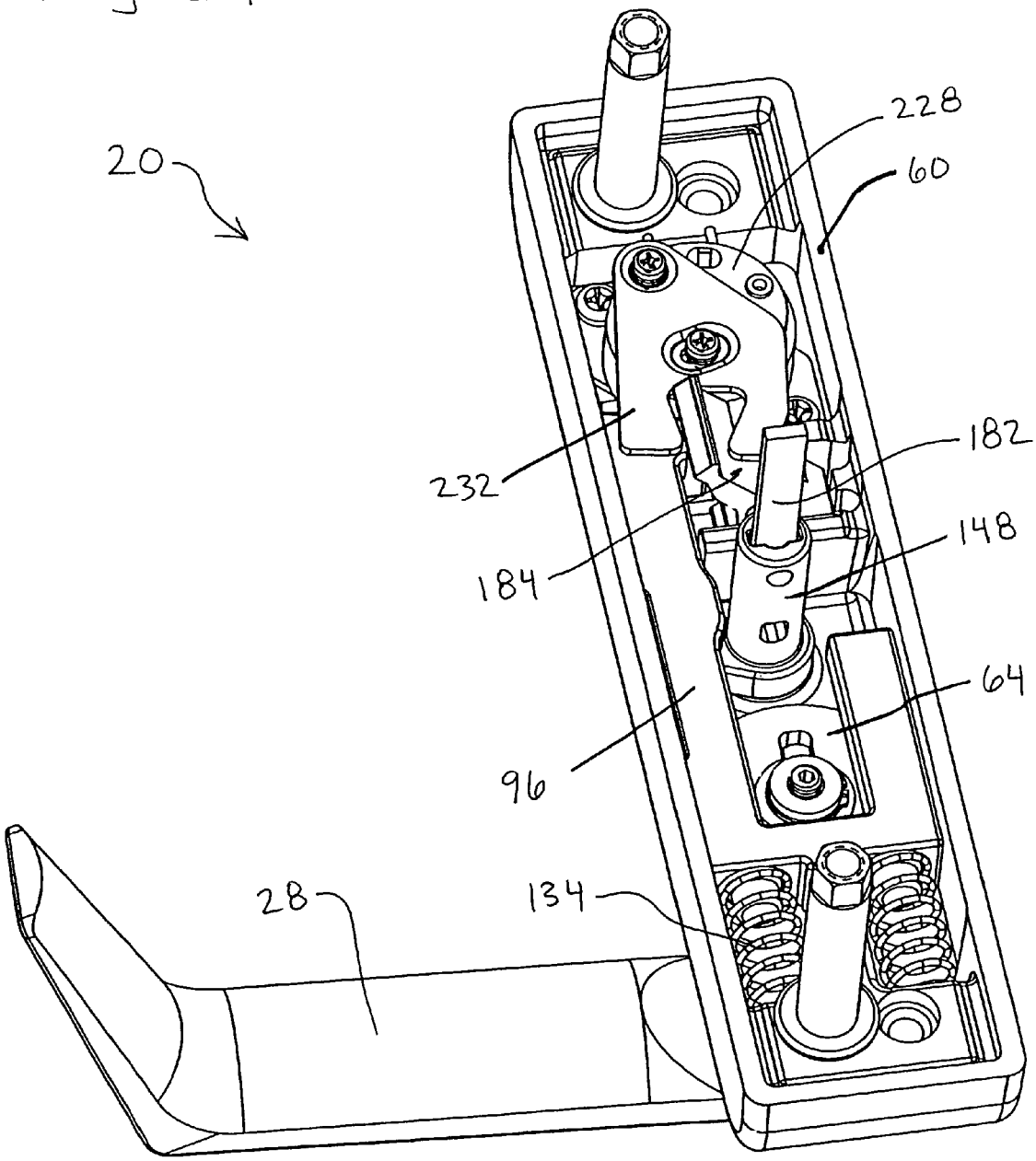
FIG. 24 is a perspective view of the control, with the electric solenoid, in an unlocked state.
Figure 25:
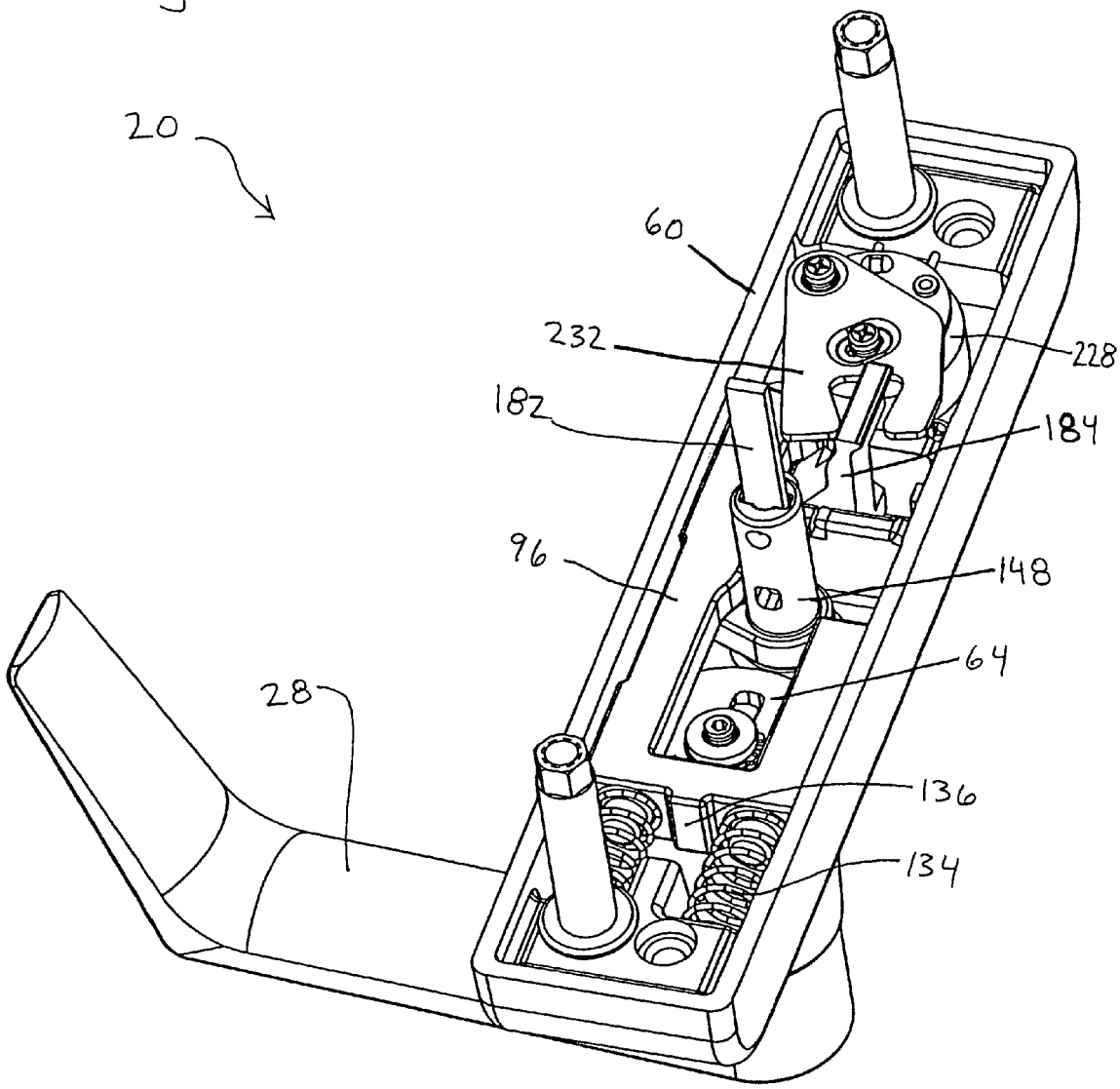
FIG. 25 is a perspective view of the control, with the electric solenoid, in a locked state.

FIGS. 23-25 illustrate an alternate embodiment, in which the control 20 is electrically locked or unlocked with a solenoid 228 and corresponding solenoid actuator lever 232. The solenoid 228 replaces the standard key cylinder 40 and allows the control 20 to be linked to an electronic security system. The torsion spring 216 is removed, but the rest of the control 20, as described above, remains the same except for minor machining of the housing 60 and back plate 62 to accommodate the solenoid 228. When used with a solenoid 228, the control 20 can be configured in a fail secure or a fail safe mode of operation, depending on the solenoid 228 installed. Two types of solenoids are distinguished by the direction in which they rotate when electrically powered. A first type rotates counter-clockwise (as viewed from FIGS. 24 and 25) under electric power to lock the control 20. If power is lost, a spring within the solenoid 228 returns the control 20 to the unlocked state. This configuration is known in the art as fail safe—the door may be opened with the lever 28 if power to the solenoid is lost. A second type of solenoid rotates clockwise (as viewed from FIGS. 24 and 25) when electrically powered to unlock the control 20. If power to the second type of solenoid is lost, the internal spring of the solenoid 228 returns the control 20 to the locked state. This configuration is known in the art as fail secure—the door cannot be opened with the lever 28 if power to the solenoid is lost. The novelty of the present invention includes, among other things, that the control 20 may be configured to either operate in electric fail secure or fail safe modes by only changing the solenoid 228, and further, that the control 20 may be enabled to lock or unlock electronically by only replacing the key cylinder 40 and actuator lever 44 with a solenoid 228, solenoid actuator lever 232, and associated mounting hardware along with the minor machining of the housing 60 and back plate 62.

Thus, the invention provides, among other things, a narrow stile control 20 with a construction including a novel swivel locking latch 184, the control 20 accepting bi-directional input, being easily converted between ANSI 08 and ANSI 09 locking functions, and being easily adaptable to two modes of electric locking control with the addition of a solenoid 228. Various features and advantages of the invention are set forth in the following claims.

What is claimed is:

1. A control assembly configured for a narrow stile door and for interaction with an exit device, the control assembly providing a means to translate a user input motion to operate a centercase, the control assembly comprising:

a housing;

a slider within the housing capable of sliding movement along a path relative to the housing between a first position corresponding to an extended latchbolt and a second position corresponding to a withdrawn latchbolt, the withdrawn latchbolt allowing the door to be opened;

an input cam, rotatable to force the slider to move relative to the housing;

an output cam, in contact with the slider and rotatable by the sliding movement of the slider, such that output cam rotation interacts with the centercase to move the latchbolt against a biasing force; and a standard key cylinder with a locking actuator lever, the locking actuator lever being rotatable around an axis parallel with the axis of the key cylinder itself;

a swivel locking latch, rotatable into the path of the slider to prevent the slider from moving out of the first position, wherein the control assembly includes a grasping member that is in rotational unity with the input cam, the grasping member operable with bi-directional movement relative to the housing, a movement in either direction resulting in an identical output to the centercase.

2. The control assembly of claim 1, wherein the control assembly is configurable between two locking functions by modifying only the key cylinder, a first locking function, which does not allow a key to be removed while the control is in an unlocked state and a second function, which allows the key to be removed while the control is in the unlocked state or in a locked state.

3. The control assembly of claim 1, wherein the control assembly is adaptable to be used on either a right side pivoting door or a left side pivoting door.

4. The control assembly of claim 3, wherein the control assembly is adapted for use on either a right or left side pivoting door by reorienting the input cam.

5. The control assembly of claim 1, wherein the output cam has a slot for accepting and following the linear movement of a pin, which is integral to the slider, the linear movement of the pin provoking a rotation of the output cam.

6. A control assembly configured for a narrow stile door and for interaction with an exit device, the control assembly providing a means to translate a user input motion to operate a centercase, the control assembly comprising:

a housing;

a slider within the housing capable of sliding movement along a path relative to the housing between a first position corresponding to an extended latchbolt and a second position corresponding to a withdrawn latchbolt, the withdrawn latchbolt allowing the door to be opened;

an input cam, rotatable to force the slider to move relative to the housing;

an output cam, in contact with the slider and rotatable by the sliding movement of the slider, such that output cam rotation interacts with the centercase to move the latchbolt against a biasing force;

a standard key cylinder with a locking actuator lever, the locking actuator lever being rotatable around an axis parallel with the axis of the key cylinder itself; and a swivel locking latch, rotatable into the path of the slider to prevent the slider from moving out of the first position, wherein the swivel locking latch pivots around an axis perpendicular to the axis of rotation of the locking actuator lever.

7. A control assembly configured for a narrow stile door and for interaction with an exit device, the control assembly providing a means to translate a user input motion to operate a centercase, the control assembly comprising:

a housing;

a slider within the housing capable of sliding movement along a path relative to the housing between a first position corresponding to an extended latchbolt and a second position corresponding to a withdrawn latchbolt, the withdrawn latchbolt allowing the door to be opened;

an input cam, rotatable to cause the slider to move relative to the housing;

an output cam, rotatable by the slider to cause the centercase to move the latch;

a standard key cylinder with a locking actuator lever, the locking actuator lever being rotatable around an axis parallel with the axis of the key cylinder itself; and a swivel locking latch, rotatable by the locking actuator lever into the path of the slider to prevent the slider from moving out of the first position, putting the control assembly into a locked condition;

the control assembly being configurable between two locking functions by modifying only the key cylinder, a first locking function, which does not allow a key to be removed while the control is in an unlocked state and a second function, which allows the key to be removed while the control is in the unlocked state or in a locked state, wherein the swivel locking latch pivots around an axis perpendicular to the axis of rotation of the locking actuator lever.

8. The control assembly of claim 7, wherein the control assembly is adaptable to be used on either a right side pivoting door or a left side pivoting door.

9. The control assembly of claim 7, wherein the control assembly is adapted for use on either a right or left side pivoting door by reorienting the input cam.

10. The control assembly of claim 7, wherein the output cam has a slot for accepting and following the linear movement of a pin, which is integral to the slider, the linear movement of the pin provoking a rotation of the output cam.

11. A control assembly configured for a narrow stile door and for interaction with an exit device, the control assembly providing a means to translate a user input motion to operate a centercase, the control assembly comprising:

a housing;

a slider within the housing capable of sliding movement along a path relative to the housing between a first position corresponding to an extended latchbolt and a second position corresponding to a withdrawn latchbolt, the withdrawn latchbolt allowing the door to be opened;

an input cam, rotatable to cause the slider to move relative to the housing;

an output cam, rotatable by the slider to cause the centercase to move the latch;

a standard key cylinder with a locking actuator lever, the locking actuator lever being rotatable around an axis parallel with the axis of the key cylinder itself; and a swivel locking latch, rotatable by the locking actuator lever into the path of the slider to prevent the slider from moving out of the first position, putting the control assembly into a locked condition;

the control assembly being configurable between two locking functions by modifying only the key cylinder, a first locking function, which does not allow a key to be removed while the control is in an unlocked state and a second function, which allows the key to be removed while the control is in the unlocked state or in a locked state, wherein the control assembly includes a grasping member that is in rotational unity with the input cam, the grasping member operable with bi-directional movement relative to the housing, a movement in either direction resulting in an identical output to the centercase.

12. A control assembly, for mounting to an exit device, the control assembly providing a means to translate a user input motion to operate a centercase, the control assembly comprising:

a housing;

a slider within the housing capable of sliding movement along a path relative to the housing between a first position corresponding to an extended latchbolt and a second position corresponding to a withdrawn latchbolt, the withdrawn latchbolt allowing the door to be opened;

an input cam, rotatable to force the slider to move relative to the housing;

an output cam, in contact with the slider and rotatable by the sliding movement of the slider, such that output cam rotation interacts with the centercase to move the latchbolt against a biasing force; and a standard key cylinder with a locking actuator lever, the locking actuator lever being rotatable around an axis parallel with the axis of the key cylinder itself;

a swivel locking latch, rotatable into the path of the slider to prevent the slider from moving out of the first position, the swivel locking latch being pivotable around an axis perpendicular to the axis of rotation of the locking actuator lever.

13. The control assembly of claim 12, wherein the swivel locking latch pivots around an axis perpendicular to the axis of rotation of the locking actuator lever.

14. The control assembly of claim 12, wherein the control assembly includes a grasping member that is in rotational unity with the input cam, the grasping member operable with bi-directional movement relative to the housing, a movement in either direction resulting in an identical output to the centercase.

15. The control assembly of claim 12, wherein the control assembly is configurable between two locking functions by modifying only the key cylinder, a first locking function, which does not allow a key to be removed while the control is in an unlocked state and a second function, which allows the key to be removed while the control is in the unlocked state or in a locked state.

16. The control assembly of claim 12, wherein the control assembly is adaptable to be used on either a right side pivoting door or a left side pivoting door.

17. The control assembly of claim 16, wherein the control assembly is adapted for use on either a right or left side pivoting door by reorienting the input cam.

18. The control assembly of claim 12, wherein the output cam has a slot for accepting and following the linear movement of a pin, which is integral to the slider, the linear movement of the pin provoking a rotation of the output cam.

19. A control assembly configured for a narrow stile door and for interaction with an exit device, the control assembly providing a means to translate a user input motion to operate a centercase, the control assembly comprising:

a housing;

a slider within the housing capable of sliding movement along a path relative to the housing between a first position corresponding to an extended latchbolt and a second position corresponding to a withdrawn latchbolt, the withdrawn latchbolt allowing the door to be opened;

an input cam, rotatable to force the slider to move relative to the housing;

an output cam, in contact with the slider and rotatable by the sliding movement of the slider, such that output cam rotation interacts with the centercase to move the latchbolt against a biasing force;

a swivel locking latch, rotatable into the path of the slider to prevent the slider from moving out of the first position; and a solenoid disposed at least partially within the housing, the solenoid operable to rotate the swivel locking latch into a first position, clear of the slider path, upon being energized, wherein the solenoid is biased into a second position, wherein the swivel locking latch is in the path of the slider to inhibit movement of the slider.

20. The control assembly of claim 19, wherein the solenoid is a rotary solenoid.

21. A control assembly configured for a narrow stile door and for interaction with an exit device, the control assembly providing a means to translate a user input motion to operate a centercase, the control assembly comprising:

a housing;

a slider within the housing capable of sliding movement along a path relative to the housing between a first position corresponding to an extended latchbolt and a second position corresponding to a withdrawn latchbolt, the withdrawn latchbolt allowing the door to be opened;

an input cam, rotatable to force the slider to move relative to the housing;

an output cam, in contact with the slider and rotatable by the sliding movement of the slider, such that output cam rotation interacts with the centercase to move the latchbolt against a biasing force;

a swivel locking latch, rotatable into the path of the slider to prevent the slider from moving out of the first position; and a solenoid disposed at least partially within the housing, the solenoid operable, upon being energized, to rotate the swivel locking latch into a first position that is in the path of the slider to inhibit movement of the slider, wherein the solenoid is biased into a second position, wherein the swivel locking latch is clear of the path of the slider to allow movement of the slider.

22. The control assembly of claim 21, wherein the solenoid is a rotary solenoid.

* * * * *